US010732546B2

(12) United States Patent
Hoshino et al.

(10) Patent No.: US 10,732,546 B2
(45) Date of Patent: Aug. 4, 2020

(54) IMAGE FORMING APPARATUS AND IMAGE FORMING METHOD

(71) Applicant: Oki Data Corporation, Tokyo (JP)

(72) Inventors: Masahiko Hoshino, Tokyo (JP); Kentaro Hasegawa, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 16/389,503

(22) Filed: Apr. 19, 2019

(65) Prior Publication Data

US 2019/0361378 A1 Nov. 28, 2019

(30) Foreign Application Priority Data

May 24, 2018 (JP) ..... 2018-099914

(51) Int. Cl.
*G03G 15/00* (2006.01)
*G03G 15/16* (2006.01)

(52) U.S. Cl.
CPC ..... *G03G 15/161* (2013.01); *G03G 15/5054* (2013.01)

(58) Field of Classification Search
CPC .. G03G 15/55; G03G 15/161; G03G 15/5054; G03G 15/553; G03G 21/12; G03G 2221/0005
USPC ..... 399/9, 34, 35, 38, 43, 71, 107, 110, 120, 399/121
See application file for complete search history.

(56) References Cited

U.S. PATENT DOCUMENTS

| | | | | |
|---|---|---|---|---|
| 7,403,738 | B2 * | 7/2008 | Murakami | G03G 21/12 399/360 |
| 8,452,199 | B2 * | 5/2013 | Kumagai | G03G 21/12 399/120 |
| 9,557,705 | B2 * | 1/2017 | Koseki | G03G 21/10 |

FOREIGN PATENT DOCUMENTS

| | | | |
|---|---|---|---|
| JP | H08-292696 | A | 11/1996 |
| JP | 2001075439 | A | 3/2001 |
| JP | 2006330460 | A | 12/2006 |
| JP | 2011138029 | A | 7/2011 |
| JP | 2013142864 | A | 7/2013 |

* cited by examiner

*Primary Examiner* — Hoan H Tran
(74) *Attorney, Agent, or Firm* — Rabin & Berdo, P.C.

(57) ABSTRACT

An image forming apparatus includes a developing unit, a transfer section, and a calculator. The developing unit includes an image carrier carrying a developer image. The transfer section includes a transfer belt, a cleaning member, and a container, and transfers the developer image onto a print medium. The transfer belt is disposed in contact with the image carrier. The cleaning member removes a developer attached to the transfer belt. The container contains the developer removed by the cleaning member. The calculator calculates a collection amount on the basis of medium information of the print medium. The collection amount is an amount of the developer collected in the container.

10 Claims, 24 Drawing Sheets

120

| | | MEDIUM LENGTH T1 (mm) | | | | | |
|---|---|---|---|---|---|---|---|
| | | T1 < 90 | 90 ≤ T1 < 120 | 120 ≤ T1 < 150 | 150 ≤ T1 < 180 | 180 ≤ T1 < 210 | 210 ≤ T1 |
| MEDIUM WIDTH Y1 (mm) | Y1 < 35 | 0.93 | 0.91 | 0.89 | 0.88 | 0.87 | 0.86 |
| | 35 ≤ Y1 < 50 | 0.89 | 0.87 | 0.85 | 0.83 | 0.81 | 0.79 |
| | 50 ≤ Y1 < 65 | 0.85 | 0.82 | 0.79 | 0.76 | 0.73 | 0.73 |
| | 65 ≤ Y1 < 80 | 0.81 | 0.77 | 0.73 | 0.69 | 0.66 | 0.64 |
| | 80 ≤ Y1 | 0.77 | 0.73 | 0.68 | 0.64 | 0.60 | 0.57 |

FIG. 6

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 86% | 85% | 2% | ○ | 62% | 65% | -3% | ○ | 91% | 94% | -3% | ○ |
| | 115 | 82% | 83% | 1% | ○ | 48% | 50% | -2% | ○ | 88% | 91% | -3% | ○ |
| | 135 | 78% | 80% | -2% | ○ | 39% | 42% | -3% | ○ | 86% | 90% | -4% | ○ |
| | 165 | 74% | 76% | -2% | ○ | 26% | 30% | -4% | ○ | 83% | 85% | -2% | ○ |
| | 195 | 69% | 70% | -1% | ○ | 13% | 17% | -4% | ○ | 80% | 82% | -2% | ○ |
| | 216 | 69% | 67% | -1% | ○ | 3% | 5% | -2% | ○ | 77% | 80% | -3% | ○ |
| 40 | 85 | 92% | 93% | -1% | ○ | 76% | 78% | -2% | ○ | 94% | 95% | -1% | ○ |
| | 115 | 89% | 90% | -1% | ○ | 68% | 70% | -2% | ○ | 92% | 94% | -2% | ○ |
| | 135 | 87% | 88% | -1% | ○ | 62% | 63% | -1% | ○ | 91% | 92% | -1% | ○ |
| | 165 | 84% | 86% | -2% | ○ | 54% | 56% | -2% | ○ | 89% | 90% | -1% | ○ |
| | 195 | 81% | 82% | -1% | ○ | 45% | 50% | -5% | ○ | 87% | 87% | 0% | ○ |
| | 216 | 78% | 80% | -2% | ○ | 39% | 43% | -4% | ○ | 86% | 88% | -2% | ○ |
| 55 | 85 | 94% | 95% | -1% | ○ | 83% | 85% | -2% | ○ | 96% | 96% | 0% | ○ |
| | 115 | 92% | 93% | -1% | ○ | 77% | 80% | -3% | ○ | 95% | 94% | 1% | ○ |
| | 135 | 90% | 90% | 0% | ○ | 72% | 75% | -3% | ○ | 94% | 93% | 1% | ○ |
| | 165 | 88% | 87% | 1% | ○ | 66% | 70% | -4% | ○ | 92% | 90% | 2% | ○ |
| | 195 | 86% | 85% | 1% | ○ | 60% | 65% | -5% | ○ | 91% | 88% | 3% | ○ |
| | 216 | 84% | 81% | 3% | ○ | 56% | 61% | -5% | ○ | 90% | 87% | 3% | ○ |
| 70 | 85 | 95% | 95% | 0% | ○ | 86% | 88% | -2% | ○ | 97% | 97% | 0% | ○ |
| | 115 | 93% | 92% | 1% | ○ | 82% | 83% | -1% | ○ | 96% | 95% | 1% | ○ |
| | 135 | 92% | 90% | 2% | ○ | 78% | 79% | -1% | ○ | 95% | 93% | 2% | ○ |
| | 165 | 91% | 88% | 3% | ○ | 74% | 75% | -1% | ○ | 94% | 91% | 3% | ○ |
| | 195 | 89% | 85% | 4% | ○ | 69% | 70% | -1% | ○ | 93% | 86% | 7% | ○ |
| | 216 | 88% | 82% | 6% | ○ | 65% | 66% | -1% | ○ | 92% | 85% | 7% | ○ |
| 86 | 85 | 96% | 96% | 0% | ○ | 89% | 90% | -1% | ○ | 97% | 98% | -1% | ○ |
| | 115 | 95% | 93% | 2% | ○ | 85% | 87% | -2% | ○ | 97% | 96% | 1% | ○ |
| | 135 | 94% | 90% | 4% | ○ | 82% | 85% | -3% | ○ | 96% | 93% | 3% | ○ |
| | 165 | 92% | 87% | 5% | ○ | 78% | 80% | -2% | ○ | 95% | 91% | 4% | ○ |
| | 195 | 91% | 85% | 6% | ○ | 75% | 78% | -3% | ○ | 94% | 90% | 4% | ○ |
| | 216 | 90% | 83% | 7% | ○ | 72% | 74% | -2% | ○ | 93% | 88% | 5% | ○ |

FIG. 8

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 87% | 86% | 1% | ○ | 62% | 57% | 5% | ○ | 91% | 93% | -2% | ○ |
| | 115 | 82% | 86% | -3% | ○ | 49% | 57% | -8% | ○ | 88% | 93% | -5% | ○ |
| | 135 | 79% | 86% | -6% | ○ | 40% | 57% | -17% | × | 86% | 93% | -7% | ○ |
| | 165 | 74% | 86% | -11% | × | 27% | 57% | -30% | × | 83% | 93% | -10% | × |
| | 195 | 70% | 86% | -16% | × | 14% | 57% | -43% | × | 80% | 93% | -13% | × |
| | 216 | 67% | 86% | -19% | × | 4% | 57% | -53% | × | 78% | 93% | -15% | × |
| 40 | 85 | 92% | 86% | 6% | ○ | 76% | 57% | 20% | × | 95% | 93% | 1% | ○ |
| | 115 | 89% | 86% | 3% | ○ | 68% | 57% | 11% | × | 93% | 93% | -1% | ○ |
| | 135 | 87% | 86% | 1% | ○ | 63% | 57% | 6% | ○ | 92% | 93% | -2% | ○ |
| | 165 | 84% | 86% | -2% | ○ | 54% | 57% | -3% | ○ | 90% | 93% | -4% | ○ |
| | 195 | 81% | 86% | -4% | ○ | 46% | 57% | -11% | × | 88% | 93% | -6% | ○ |
| | 216 | 79% | 86% | -6% | ○ | 40% | 57% | -17% | × | 86% | 93% | -7% | ○ |
| 55 | 85 | 94% | 86% | 8% | ○ | 83% | 57% | 26% | × | 96% | 93% | 3% | ○ |
| | 115 | 92% | 86% | 6% | ○ | 77% | 57% | 20% | × | 95% | 93% | 1% | ○ |
| | 135 | 90% | 86% | 5% | ○ | 73% | 57% | 16% | × | 94% | 93% | 1% | ○ |
| | 165 | 88% | 86% | 3% | ○ | 67% | 57% | 10% | × | 92% | 93% | -1% | ○ |
| | 195 | 86% | 86% | 1% | ○ | 61% | 57% | 4% | ○ | 91% | 93% | -2% | ○ |
| | 216 | 85% | 86% | -1% | ○ | 56% | 57% | 0% | ○ | 90% | 93% | -3% | ○ |
| 70 | 85 | 95% | 86% | 10% | × | 87% | 57% | 30% | × | 97% | 93% | 4% | ○ |
| | 115 | 94% | 86% | 8% | ○ | 82% | 57% | 25% | × | 96% | 93% | 3% | ○ |
| | 135 | 93% | 86% | 7% | ○ | 79% | 57% | 22% | × | 95% | 93% | 2% | ○ |
| | 165 | 91% | 86% | 5% | ○ | 74% | 57% | 17% | × | 94% | 93% | 1% | ○ |
| | 195 | 89% | 86% | 4% | ○ | 69% | 57% | 12% | × | 93% | 93% | 0% | ○ |
| | 216 | 88% | 86% | 3% | ○ | 66% | 57% | 9% | ○ | 92% | 93% | -1% | ○ |
| 86 | 85 | 96% | 86% | 11% | × | 89% | 57% | 32% | × | 98% | 93% | 4% | ○ |
| | 115 | 95% | 86% | 9% | ○ | 85% | 57% | 28% | × | 97% | 93% | 3% | ○ |
| | 135 | 94% | 86% | 8% | ○ | 83% | 57% | 26% | × | 96% | 93% | 3% | ○ |
| | 165 | 93% | 86% | 7% | ○ | 79% | 57% | 22% | × | 95% | 93% | 2% | ○ |
| | 195 | 91% | 86% | 6% | ○ | 75% | 57% | 18% | × | 94% | 93% | 1% | ○ |
| | 216 | 90% | 86% | 5% | ○ | 72% | 57% | 15% | × | 94% | 93% | 0% | ○ |

FIG. 9

130A

| | | MEDIUM LENGTH T1 (mm) | | | | | |
|---|---|---|---|---|---|---|---|
| | | T1 < 90 | 90 ≤ T1 < 120 | 120 ≤ T1 < 150 | 150 ≤ T1 < 180 | 180 ≤ T1 < 210 | 210 ≤ T1 |
| MEDIUM WIDTH Y1 (mm) | Y1<35 | 0.88 | 0.86 | 0.84 | 0.82 | 0.81 | 0.80 |
| | 35 ≤ Y1 < 50 | 0.82 | 0.79 | 0.77 | 0.74 | 0.72 | 0.71 |
| | 50 ≤ Y1 < 65 | 0.75 | 0.71 | 0.68 | 0.65 | 0.62 | 0.62 |
| | 65 ≤ Y1 < 80 | 0.68 | 0.63 | 0.59 | 0.55 | 0.52 | 0.50 |
| | 80 ≤ Y1 | 0.62 | 0.57 | 0.51 | 0.47 | 0.43 | 0.40 |

FIG. 11A

130B

| | | MEDIUM LENGTH T1 (mm) | | | | | |
|---|---|---|---|---|---|---|---|
| | | T1 < 90 | 90 ≤ T1 < 120 | 120 ≤ T1 < 150 | 150 ≤ T1 < 180 | 180 ≤ T1 < 210 | 210 ≤ T1 |
| MEDIUM WIDTH Y1 (mm) | Y1<35 | 0.86 | 0.84 | 0.82 | 0.80 | 0.79 | 0.78 |
| | 35 ≤ Y1 < 50 | 0.79 | 0.76 | 0.74 | 0.72 | 0.70 | 0.69 |
| | 50 ≤ Y1 < 65 | 0.71 | 0.67 | 0.64 | 0.61 | 0.58 | 0.59 |
| | 65 ≤ Y1 < 80 | 0.63 | 0.58 | 0.54 | 0.50 | 0.47 | 0.45 |
| | 80 ≤ Y1 | 0.57 | 0.51 | 0.45 | 0.41 | 0.37 | 0.35 |

FIG. 11B

130C

| | | MEDIUM LENGTH T1 (mm) | | | | | |
|---|---|---|---|---|---|---|---|
| | | T1 < 90 | 90 ≤ T1 < 120 | 120 ≤ T1 < 150 | 150 ≤ T1 < 180 | 180 ≤ T1 < 210 | 210 ≤ T1 |
| MEDIUM WIDTH Y1 (mm) | Y1<35 | 0.84 | 0.82 | 0.80 | 0.79 | 0.78 | 0.77 |
| | 35 ≤ Y1 < 50 | 0.76 | 0.73 | 0.71 | 0.69 | 0.68 | 0.67 |
| | 50 ≤ Y1 < 65 | 0.67 | 0.63 | 0.60 | 0.57 | 0.55 | 0.56 |
| | 65 ≤ Y1 < 80 | 0.58 | 0.53 | 0.49 | 0.46 | 0.43 | 0.41 |
| | 80 ≤ Y1 | 0.51 | 0.45 | 0.40 | 0.36 | 0.33 | 0.31 |

FIG. 11C n=3

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 82% | 81% | 2% | ○ | 59% | 62% | -3% | ○ | 87% | 89% | -3% | ○ |
| | 115 | 77% | 78% | -1% | ○ | 46% | 47% | -1% | ○ | 83% | 86% | -3% | ○ |
| | 135 | 74% | 75% | -1% | ○ | 37% | 40% | -2% | ○ | 81% | 85% | -4% | ○ |
| | 165 | 69% | 72% | -2% | ○ | 25% | 28% | -4% | ○ | 78% | 80% | -2% | ○ |
| | 195 | 65% | 66% | -1% | ○ | 12% | 15% | -4% | ○ | 75% | 77% | -2% | ○ |
| | 216 | 62% | 63% | -1% | ○ | 3% | 5% | -2% | ○ | 73% | 75% | -2% | ○ |
| 55 | 85 | 84% | 85% | -1% | ○ | 74% | 79% | -5% | ○ | 86% | 86% | 0% | ○ |
| | 115 | 82% | 83% | -1% | ○ | 68% | 71% | -3% | ○ | 84% | 84% | 0% | ○ |
| | 135 | 80% | 80% | 0% | ○ | 64% | 67% | -2% | ○ | 83% | 83% | 1% | ○ |
| | 165 | 78% | 77% | 1% | ○ | 59% | 62% | -3% | ○ | 82% | 80% | 2% | ○ |
| | 195 | 76% | 75% | 1% | ○ | 53% | 58% | -4% | ○ | 80% | 78% | 2% | ○ |
| | 216 | 75% | 72% | 3% | ○ | 50% | 54% | -4% | ○ | 80% | 78% | 2% | ○ |
| 86 | 85 | 78% | 81% | -3% | ○ | 67% | 70% | -3% | ○ | 81% | 83% | -3% | ○ |
| | 115 | 75% | 78% | -3% | ○ | 59% | 63% | -3% | ○ | 78% | 80% | -2% | ○ |
| | 135 | 73% | 75% | -2% | ○ | 55% | 58% | -3% | ○ | 76% | 77% | -1% | ○ |
| | 165 | 71% | 72% | -1% | ○ | 49% | 53% | -4% | ○ | 75% | 75% | -1% | ○ |
| | 195 | 68% | 70% | -2% | ○ | 42% | 48% | -6% | ○ | 73% | 74% | -1% | ○ |
| | 216 | 67% | 69% | -2% | ○ | 38% | 43% | -5% | ○ | 72% | 73% | -1% | ○ |

FIG. 13A n=5

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 80% | 79% | 2% | ○ | 58% | 60% | -3% | ○ | 85% | 87% | -3% | ○ |
| | 115 | 76% | 77% | -1% | ○ | 45% | 46% | -1% | ○ | 81% | 84% | -3% | ○ |
| | 135 | 73% | 74% | -1% | ○ | 36% | 39% | -2% | ○ | 79% | 83% | -4% | ○ |
| | 165 | 68% | 70% | -2% | ○ | 24% | 28% | -4% | ○ | 76% | 79% | -2% | ○ |
| | 195 | 64% | 65% | -1% | ○ | 12% | 15% | -3% | ○ | 74% | 76% | -2% | ○ |
| | 216 | 61% | 62% | -1% | ○ | 3% | 5% | -2% | ○ | 72% | 74% | -2% | ○ |
| 55 | 85 | 81% | 82% | -1% | ○ | 71% | 76% | -5% | ○ | 83% | 83% | 0% | ○ |
| | 115 | 78% | 79% | -1% | ○ | 65% | 68% | -3% | ○ | 80% | 80% | 0% | ○ |
| | 135 | 77% | 76% | 0% | ○ | 62% | 64% | -2% | ○ | 79% | 79% | 0% | ○ |
| | 165 | 75% | 74% | 1% | ○ | 56% | 59% | -3% | ○ | 78% | 76% | 2% | ○ |
| | 195 | 73% | 72% | 1% | ○ | 51% | 55% | -4% | ○ | 77% | 75% | 2% | ○ |
| | 216 | 72% | 70% | 3% | ○ | 48% | 52% | -4% | ○ | 77% | 75% | 2% | ○ |
| 86 | 85 | 73% | 76% | -3% | ○ | 62% | 65% | -3% | ○ | 75% | 77% | -2% | ○ |
| | 115 | 69% | 72% | -2% | ○ | 55% | 58% | -3% | ○ | 72% | 74% | -2% | ○ |
| | 135 | 68% | 69% | -2% | ○ | 51% | 54% | -3% | ○ | 71% | 72% | -1% | ○ |
| | 165 | 66% | 67% | -1% | ○ | 45% | 49% | -4% | ○ | 70% | 70% | 0% | ○ |
| | 195 | 64% | 66% | -2% | ○ | 40% | 45% | -5% | ○ | 69% | 70% | -1% | ○ |
| | 216 | 63% | 65% | -2% | ○ | 36% | 40% | -5% | ○ | 68% | 68% | 0% | ○ |

FIG. 13B n=10

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 79% | 77% | 2% | ○ | 56% | 59% | -3% | ○ | 83% | 86% | -3% | ○ |
| | 115 | 74% | 75% | -1% | ○ | 44% | 45% | -1% | ○ | 80% | 82% | -3% | ○ |
| | 135 | 71% | 73% | -1% | ○ | 36% | 38% | -2% | ○ | 78% | 82% | -4% | ○ |
| | 165 | 67% | 69% | -2% | ○ | 24% | 27% | -4% | ○ | 75% | 77% | -2% | ○ |
| | 195 | 63% | 64% | -1% | ○ | 11% | 15% | -3% | ○ | 72% | 75% | -2% | ○ |
| | 216 | 60% | 61% | -1% | ○ | 3% | 5% | -2% | ○ | 71% | 73% | -2% | ○ |
| 55 | 85 | 77% | 78% | -1% | ○ | 68% | 72% | -4% | ○ | 79% | 79% | 0% | ○ |
| | 115 | 74% | 75% | -1% | ○ | 62% | 65% | -3% | ○ | 77% | 76% | 0% | ○ |
| | 135 | 73% | 73% | 0% | ○ | 59% | 61% | -2% | ○ | 76% | 76% | 0% | ○ |
| | 165 | 72% | 71% | 1% | ○ | 54% | 57% | -3% | ○ | 75% | 73% | 2% | ○ |
| | 195 | 70% | 70% | 1% | ○ | 49% | 53% | -4% | ○ | 74% | 72% | 2% | ○ |
| | 216 | 70% | 67% | 3% | ○ | 46% | 51% | -4% | ○ | 75% | 72% | 2% | ○ |
| 86 | 85 | 68% | 70% | -3% | ○ | 58% | 60% | -2% | ○ | 70% | 72% | -2% | ○ |
| | 115 | 64% | 66% | -2% | ○ | 51% | 54% | -3% | ○ | 67% | 69% | -2% | ○ |
| | 135 | 63% | 65% | -1% | ○ | 48% | 50% | -3% | ○ | 66% | 67% | -1% | ○ |
| | 165 | 61% | 63% | -1% | ○ | 42% | 46% | -4% | ○ | 65% | 66% | 0% | ○ |
| | 195 | 60% | 62% | -2% | ○ | 37% | 42% | -5% | ○ | 64% | 65% | -1% | ○ |
| | 216 | 59% | 61% | -2% | ○ | 34% | 38% | -4% | ○ | 64% | 64% | 0% | ○ |

FIG. 13C n=3

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 82% | 76% | 6% | ○ | 62% | 51% | 11% | × | 83% | 83% | 0% | ○ |
| | 115 | 78% | 76% | 1% | ○ | 50% | 51% | -1% | ○ | 78% | 83% | -5% | ○ |
| | 135 | 75% | 76% | -2% | ○ | 42% | 51% | -9% | ○ | 75% | 83% | -8% | ○ |
| | 165 | 70% | 76% | -6% | ○ | 30% | 51% | -21% | × | 71% | 83% | -12% | × |
| | 195 | 66% | 76% | -10% | × | 18% | 51% | -33% | × | 67% | 83% | -16% | × |
| | 216 | 63% | 76% | -14% | × | 10% | 51% | -41% | × | 64% | 83% | -19% | × |
| 55 | 85 | 85% | 76% | 8% | ○ | 75% | 51% | 24% | × | 86% | 83% | 3% | ○ |
| | 115 | 82% | 76% | 6% | ○ | 68% | 51% | 18% | × | 84% | 83% | 1% | ○ |
| | 135 | 80% | 76% | 4% | ○ | 65% | 51% | 14% | × | 83% | 83% | 0% | ○ |
| | 165 | 78% | 76% | 2% | ○ | 59% | 51% | 8% | ○ | 82% | 83% | -1% | ○ |
| | 195 | 76% | 76% | 0% | ○ | 54% | 51% | 3% | ○ | 81% | 83% | -3% | ○ |
| | 216 | 76% | 76% | -1% | ○ | 50% | 51% | 0% | ○ | 80% | 83% | -3% | ○ |
| 86 | 85 | 79% | 76% | 2% | ○ | 74% | 51% | 24% | × | 81% | 83% | -2% | ○ |
| | 115 | 75% | 76% | -1% | ○ | 69% | 51% | 19% | × | 79% | 83% | -4% | ○ |
| | 135 | 73% | 76% | -3% | ○ | 67% | 51% | 16% | × | 78% | 83% | -6% | ○ |
| | 165 | 71% | 76% | -5% | ○ | 63% | 51% | 12% | × | 76% | 83% | -7% | ○ |
| | 195 | 69% | 76% | -7% | ○ | 59% | 51% | 9% | ○ | 75% | 83% | -8% | ○ |
| | 216 | 67% | 76% | -9% | ○ | 57% | 51% | 6% | ○ | 74% | 83% | -9% | ○ |

FIG. 14A n=5

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 81% | 73% | 7% | ○ | 60% | 49% | 11% | × | 81% | 80% | 1% | ○ |
| | 115 | 76% | 73% | 3% | ○ | 48% | 49% | 0% | ○ | 77% | 80% | -4% | ○ |
| | 135 | 73% | 73% | 0% | ○ | 41% | 49% | -8% | ○ | 74% | 80% | -6% | ○ |
| | 165 | 69% | 73% | -5% | ○ | 29% | 49% | -20% | × | 70% | 80% | -10% | × |
| | 195 | 65% | 73% | -9% | ○ | 18% | 49% | -31% | × | 66% | 80% | -15% | × |
| | 216 | 62% | 73% | -12% | × | 10% | 49% | -39% | × | 63% | 80% | -17% | × |
| 55 | 85 | 81% | 73% | 7% | ○ | 71% | 49% | 22% | × | 83% | 80% | 3% | ○ |
| | 115 | 78% | 73% | 5% | ○ | 65% | 49% | 16% | × | 81% | 80% | 0% | ○ |
| | 135 | 77% | 73% | 3% | ○ | 62% | 49% | 13% | × | 80% | 80% | -1% | ○ |
| | 165 | 75% | 73% | 1% | ○ | 57% | 49% | 8% | ○ | 78% | 80% | -2% | ○ |
| | 195 | 73% | 73% | 0% | ○ | 52% | 49% | 3% | ○ | 77% | 80% | -3% | ○ |
| | 216 | 73% | 73% | -1% | ○ | 49% | 49% | 0% | ○ | 77% | 80% | -3% | ○ |
| 86 | 85 | 73% | 73% | 0% | ○ | 69% | 49% | 20% | × | 76% | 80% | -4% | ○ |
| | 115 | 70% | 73% | -4% | ○ | 64% | 49% | 15% | × | 73% | 80% | -7% | ○ |
| | 135 | 68% | 73% | -5% | ○ | 62% | 49% | 13% | × | 72% | 80% | -8% | ○ |
| | 165 | 66% | 73% | -7% | ○ | 59% | 49% | 10% | × | 71% | 80% | -9% | ○ |
| | 195 | 64% | 73% | -9% | ○ | 55% | 49% | 7% | ○ | 70% | 80% | -10% | × |
| | 216 | 63% | 73% | -10% | × | 53% | 49% | 4% | ○ | 70% | 80% | -10% | × |

FIG. 14B n=10

| MEDIUM SIZE | | ENVIRONMENT CONDITION NN | | | | ENVIRONMENT CONDITION HH | | | | ENVIRONMENT CONDITION LL | | | |
|---|---|---|---|---|---|---|---|---|---|---|---|---|---|
| MEDIUM WIDTH Y1 (mm) | MEDIUM LENGTH T1 (mm) | Rmeas | Rcal | Rmeas -Rcal | DETERMI-NATION | Rmeas | Rcal | Rmeas -Rcal | DETERMI-NATION | Rmeas | Rcal | Rmeas -Rcal | DETERMI-NATION |
| 25 | 85 | 79% | 71% | 8% | ○ | 59% | 47% | 12% | × | 80% | 78% | 2% | ○ |
| | 115 | 74% | 71% | 3% | ○ | 47% | 47% | 0% | ○ | 75% | 78% | -2% | ○ |
| | 135 | 72% | 71% | 1% | ○ | 40% | 47% | -7% | ○ | 72% | 78% | -5% | ○ |
| | 165 | 68% | 71% | -3% | ○ | 29% | 47% | -18% | × | 68% | 78% | -9% | ○ |
| | 195 | 63% | 71% | -8% | ○ | 18% | 47% | -30% | × | 65% | 78% | -13% | × |
| | 216 | 61% | 71% | -10% | × | 10% | 47% | -38% | × | 62% | 78% | -16% | × |
| 55 | 85 | 77% | 71% | 6% | ○ | 68% | 47% | 21% | × | 79% | 78% | 2% | ○ |
| | 115 | 74% | 71% | 3% | ○ | 62% | 47% | 15% | × | 77% | 78% | -1% | ○ |
| | 135 | 74% | 71% | 3% | ○ | 59% | 47% | 12% | × | 76% | 78% | -1% | ○ |
| | 165 | 72% | 71% | 1% | ○ | 54% | 47% | 7% | ○ | 75% | 78% | -2% | ○ |
| | 195 | 71% | 71% | 0% | ○ | 50% | 47% | 2% | ○ | 75% | 78% | -3% | ○ |
| | 216 | 70% | 71% | -1% | ○ | 47% | 47% | 0% | ○ | 75% | 78% | -3% | ○ |
| 86 | 85 | 68% | 71% | -3% | ○ | 64% | 47% | 17% | × | 70% | 78% | -7% | ○ |
| | 115 | 64% | 71% | -7% | ○ | 59% | 47% | 12% | × | 67% | 78% | -10% | × |
| | 135 | 63% | 71% | -8% | ○ | 58% | 47% | 10% | × | 67% | 78% | -10% | × |
| | 165 | 62% | 71% | -9% | ○ | 55% | 47% | 7% | ○ | 66% | 78% | -11% | × |
| | 195 | 60% | 71% | -11% | × | 52% | 47% | 5% | ○ | 66% | 78% | -12% | × |
| | 216 | 60% | 71% | -12% | × | 50% | 47% | 3% | ○ | 66% | 78% | -12% | × |

FIG. 14C

| MEDIUM GRAMMAGE W1 (g/m2) | CORRECTION PARAMETER Mw |
|---|---|
| 64 < W1 ≤ 74 | 1.58 |
| 74 < W1 ≤ 82 | 1.53 |
| 82 < W1 ≤ 90 | 1.48 |
| 90 < W1 ≤ 104 | 1.40 |
| 104 < W1 ≤ 120 | 1.32 |
| 120 < W1 ≤ 176 | 1.12 |
| 176 < W1 ≤ 220 | 1.00 |

| MEDIUM GRAMMAGE W1 (g/m²) | DETERMINATION | |
|---|---|---|
| | IMAGE FORMING APPARATUS 3 | IMAGE FORMING APPARATUS 3R |
| 64 < W1 ≤ 74 | ○ | × (WASTE TONER BOX 47 IS FULL) |
| 74 < W1 ≤ 82 | ○ | × (WASTE TONER BOX 47 IS FULL) |
| 82 < W1 ≤ 90 | ○ | ○ |
| 90 < W1 ≤ 104 | ○ | ○ |
| 104 < W1 ≤ 120 | ○ | ○ |
| 120 < W1 ≤ 176 | ○ | × (GIVE NOTIFICATION RELATED TO LIFE IN STATE WHERE REMAINING CONTAINABLE AMOUNT R IS EQUAL TO OR GREATER THAN 10%) |
| 176 < W1 ≤ 220 | ○ | × (GIVE NOTIFICATION RELATED TO LIFE IN STATE WHERE REMAINING CONTAINABLE AMOUNT R IS EQUAL TO OR GREATER THAN 10%) |

FIG. 19

IMAGE FORMING APPARATUS AND IMAGE FORMING METHOD

CROSS REFERENCE TO RELATED APPLICATIONS

The present application claims priority from Japanese Patent Application No. 2018-099914 filed on May 24, 2018, the entire contents of which are hereby incorporated by reference.

BACKGROUND

The technology relates to an image forming apparatus that forms an image and to an image forming method used by the image forming apparatus.

Some image forming apparatuses collect, in a collection container, a waste toner attached to a transfer belt. For example, Japanese Unexamined Patent Application Publication No. H08-292696 discloses an image forming apparatus that calculates in advance the number of sheets of print media printing on which causes the collection container to be filled with the waste toner. The image forming apparatus performs such calculation for transfer print media having various medium sizes. Further, the image forming apparatus estimates, on the basis of a result of the above-described calculation, timing at which the collection container is filled with the waste toner.

SUMMARY

It is desired that an image forming apparatus give, at appropriate timing, notification that a transfer section including a transfer belt has reached the end of its life.

It is desirable to provide an image forming apparatus and an image forming method that are each able to give notification related to a life at appropriate timing.

According to one embodiment of the technology, there is provided an image forming apparatus that includes a developing unit, a transfer section, and a calculator. The developing unit includes an image carrier carrying a developer image. The transfer section includes a transfer belt, a cleaning member, and a container, and transfers the developer image onto a print medium. The transfer belt is disposed in contact with the image carrier. The cleaning member removes a developer attached to the transfer belt. The container contains the developer removed by the cleaning member. The calculator calculates a collection amount on the basis of medium information of the print medium. The collection amount is an amount of the developer collected in the container.

According to one embodiment of the technology, there is provided an image forming method including: transferring, with a transfer section, a developer image onto a print medium, the transfer section including a transfer belt disposed in contact with an image carrier, the developer image being carried by the image carrier; removing, with a cleaning member of the transfer section, a developer attached to the transfer belt; containing, in a container of the transfer section, the developer removed by the cleaning member; and calculating, with a calculator, a collection amount on the basis of medium information of the print medium, the collection amount being an amount of the developer collected in the container.

BRIEF DESCRIPTION OF DRAWINGS

FIG. 6 is a table illustrating an example of a correction table according to one example embodiment.

FIG. 8 is a diagram illustrating an example of a result of an experiment conducted on the image forming apparatus according to one example embodiment.

FIG. 9 is a diagram illustrating an example of a result of an experiment conducted on an image forming apparatus according to a comparative example of one example embodiment.

FIG. 11A is a table illustrating an example of a correction table according to one example embodiment.

FIG. 11B is a table illustrating another example of the correction table according to one example embodiment.

FIG. 11C is a table illustrating still another example of the correction table according to one example embodiment.

FIG. 13A is a diagram illustrating an example of a result of an experiment conducted on the image forming apparatus according to one example embodiment.

FIG. 13B is a diagram illustrating another example of a result of an experiment conducted on the image forming apparatus according to one example embodiment.

FIG. 13C is a diagram illustrating still another example of a result of an experiment conducted on the image forming apparatus according to one example embodiment.

FIG. 14A is a diagram illustrating an example of a result of an experiment conducted on the image forming apparatus according to a comparative example of one example embodiment.

FIG. 14B is a diagram illustrating another example of a result of an experiment conducted on the image forming apparatus according to the comparative example of one example embodiment.

FIG. 14C is a diagram illustrating still another example of a result of an experiment conducted on the image forming apparatus according to the comparative example of one example embodiment.

FIG. 19 is a diagram illustrating an example of a result of an experiment conducted on the image forming apparatus according to one example embodiment.

DETAILED DESCRIPTION

Figure 1:
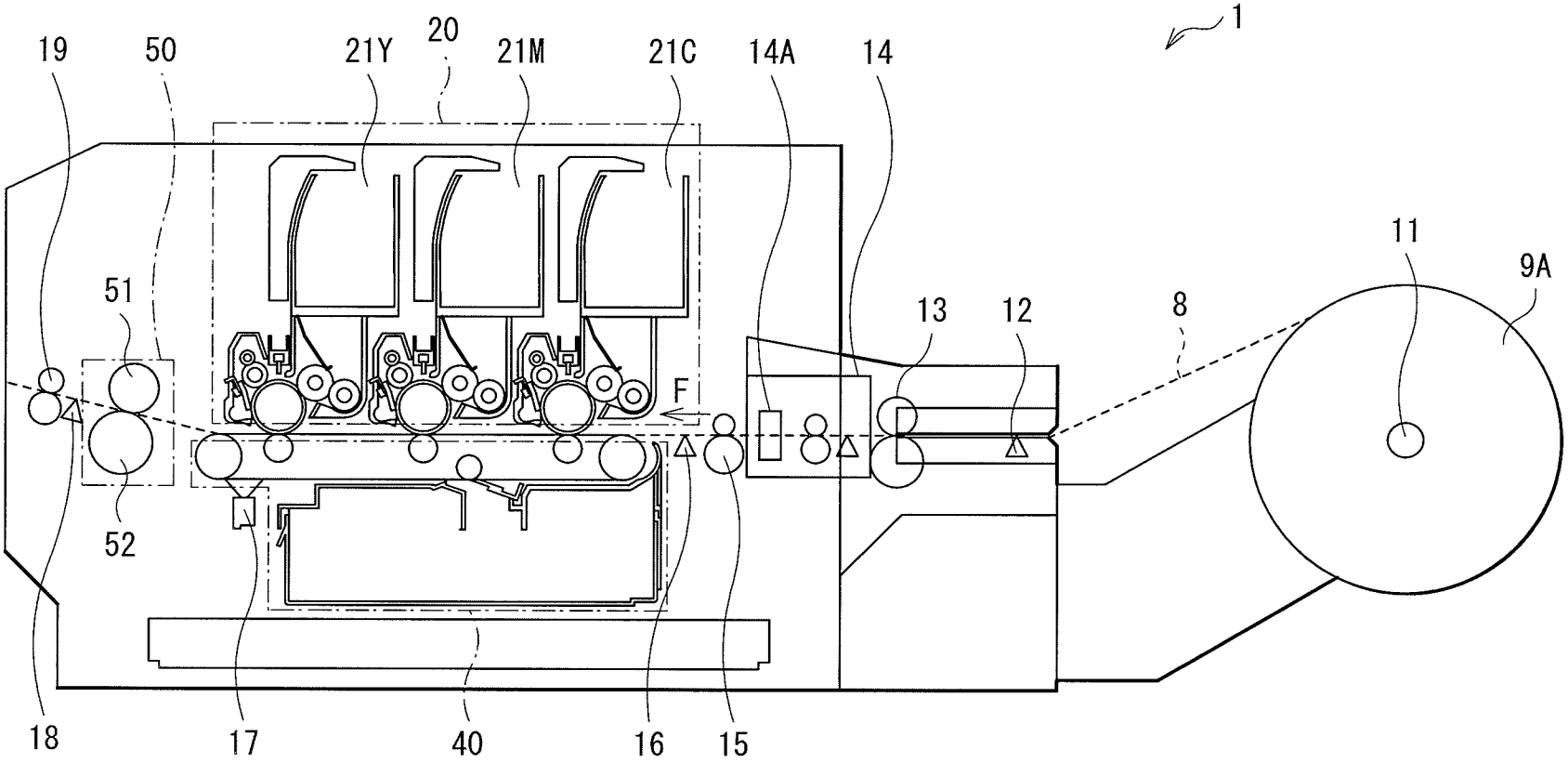
FIG. 1 is an explanatory diagram illustrating an example of a configuration of an image forming apparatus according to one example embodiment.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description will be given in the following order.

1. First Example Embodiment
2. Second Example Embodiment
3. Third Example Embodiment

1. First Example Embodiment

Configuration Example

FIG. 1 illustrates an example of a configuration of an image forming apparatus 1, i.e., an image forming apparatus according to an example embodiment of the technology. The image forming apparatus 1 may serve, for example, as a printer that forms an image on a print medium by an electrophotographic method. Non-limiting examples of the print medium may include a so-called roll of paper and any other printable medium.

The image forming apparatus 1 may include a print medium holder 11, a print medium sensor 12, a conveying roller 13, a cutter section 14, a conveying roller 15, a writing sensor 16, a developing section 20, a transfer belt section 40, a density sensor 17, a fixing section 50, a discharge sensor 18, and a discharging roller 19. The print medium sensor 12, the conveying roller 13, the cutter section 14, the conveying roller 15, the writing sensor 16, the developing section 20, the transfer belt section 40, the fixing section 50, the discharge sensor 18, and the discharging roller 19 may be disposed along a conveyance path 8 of a print medium 9.

The print medium holder 11 may hold a roll 9A of the print medium 9 in a rotatable manner. Non-limiting examples of the print medium 9 may include so-called continuous paper having a long length. The print medium 9 taken out from the roll 9A may be conveyed along the conveyance path 8.

The print medium sensor 12 may detect the print medium 9.

The conveying roller 13 may include a pair of rollers disposed with the conveyance path 8 in between. The conveying roller 13 may convey the print medium 9 along the conveyance path 8 on the basis of power transmitted from an unillustrated conveying motor, and thereby feed the print medium 9 to the cutter section 14.

The cutter section 14 may cut the print medium 9. The cutter section 14 may include a cutter 14A. In this example, the cutter 14A may cut the print medium 9 by rotating a cutter blade on the basis of power transmitted from an unillustrated cutter motor. Hereinafter, the print medium 9 that has been cut may be also referred to as a print medium 9B.

The conveying roller 15 may include a pair of rollers disposed with the conveyance path 8 in between. The conveying roller 15 may convey the print medium 9B along the conveyance path 8 on the basis of power transmitted from an unillustrated conveying motor, and thereby feed the print medium 9B to the developing section 20.

The writing sensor 16 may detect a front end of the print medium 9B that has been cut by the cutter section 14 and conveyed by the conveying roller 15. In one example, the writing sensor 16 may be a mechanical sensor. In another example, the writing sensor 16 may be an optical sensor.

The developing section 20 may form toner images of respective three colors. The developing section 20 may be attachable to and detachable from the image forming apparatus 1. The developing section 20 may include three developing units 21, i.e., a developing unit 21C, a developing unit 21M, and a developing unit 21Y. The developing unit 21C may form a cyan toner image. The developing unit 21M may form a magenta toner image. The developing unit 21Y may form a yellow toner image. The developing section 20 may transfer the toner images of the respective three colors onto the print medium 9B.

Figure 2:
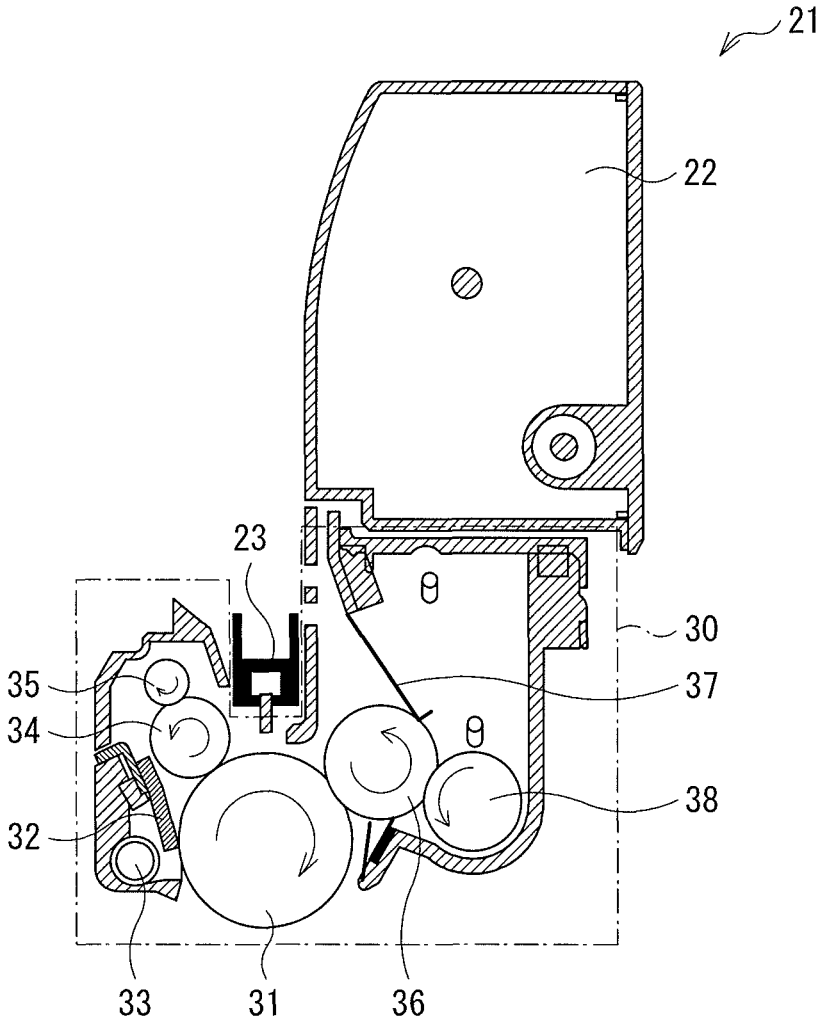
FIG. 2 is an explanatory diagram illustrating an example of a configuration of a developing unit illustrated in FIG. 1.

FIG. 2 illustrates an example of a configuration of the developing unit 21. The developing unit 21 may include a toner container 22, a developing part 30, and an exposure head 23.

The toner container 22 may contain a toner to be used in the developing unit 21. For example, the toner container 22 of the developing unit 21C may contain a cyan toner, the toner container 22 of the developing unit 21M may contain a magenta toner, and the toner container 22 of the developing unit 21Y may contain a yellow toner. The toner may include, for example but not limited to, polyester resin, a colorant, an electric charge control agent, and a release agent. The toner may be added with an external additive. Non-limiting examples of the external additive may include hydrophobic silica. The toner may be generated by, for example but not limited to, pulverization. The toner may have an average particle size of, for example but not limited to, about 7 μm. The toner container 22 may include an unillustrated waste toner box that contains a waste toner fed from the developing part 30.

The developing part 30 may include a photosensitive drum 31, a cleaning blade 32, a charging roller 34, a cleaning roller 35, a developing roller 36, a developing blade 37, and a feeding roller 38.

The photosensitive drum 31 may support an electrostatic latent image on its surface (its surficial portion). The photosensitive drum 31 may be rotated clockwise in this example by power transmitted from an unillustrated drum motor. The photosensitive drum 31 may be electrically charged by the charging roller 34 and subjected to exposure by the exposure head 23. An electrostatic latent image may be thereby formed on the surface of the photosensitive drum 31. Further, the toner may be fed to the photosensitive drum 31 by the developing roller 36. A toner image based on the electrostatic latent image may be thereby formed on the photosensitive drum 31.

The cleaning blade 32 may scrape off the toner remaining on the surface (the surficial portion) of the photosensitive drum 31 and clean the surface of the photosensitive drum 31. The cleaning blade 32 may also scrape off the toner that has been discharged on the surface of the photosensitive drum 31. The toner that has been discharged on the surface of the photosensitive drum 31 may have been left unused in the developing part 30 for a long time and therefore deteriorated. The toner scraped off may be conveyed by a conveying spiral 33 and collected as a waste toner in an unillustrated waste toner box. The waste toner box may be provided in the toner container 22.

The charging roller 34 may electrically charge the surface (the surficial portion) of the photosensitive drum 31. The charging roller 34 may be disposed in contact with a surface (a circumferential surface) of the photosensitive drum 31. The charging roller 34 may be so disposed as to be pressed against the photosensitive drum 31 by a predetermined pressing amount. The charging roller 34 may rotate counterclockwise in this example in accordance with the rotation of the photosensitive drum 31. The charging roller 34 may receive a charging voltage from a high voltage controller 67 which will be described later.

The cleaning roller 35 may clean the charging roller 34. The cleaning roller 35 may be so disposed as to be in contact with a surface (a circumferential surface) of the charging roller 34. The cleaning roller 35 may be so disposed as to be pressed against the charging roller 34 by a predetermined pressing amount. The cleaning roller 35 may be rotated clockwise in this example by power transmitted from an unillustrated drum motor.

The developing roller 36 may support the toner on its surface. The developing roller 36 may include, for example but not limited to, an electrically-conductive shaft and an elastic layer provided on a surface (a circumferential surface) of the electrically-conductive shaft. The electrically-conductive shaft may include, for example but not limited to, stainless steel. The elastic layer may include, for example but not limited to, electrically-semiconductive urethane rubber having rubber hardness of about 70 degrees. The developing roller 36 may be so disposed as to be in contact with the surface (the circumferential surface) of the photosensitive drum 31. The developing roller 36 may be so disposed as to be pressed against the photosensitive drum 31 by a predetermined pressing amount. The developing roller 36 may be rotated counterclockwise in this example by power transmitted from an unillustrated drum motor. The developing roller 36 may receive a developing voltage from the high voltage controller 67 which will be described later.

The developing blade 37 may form a layer including the toner, i.e., a toner layer, on the surface of the developing roller 36 and control or adjust the thickness of the toner layer by being brought into contact with the surface of the developing roller 36. The developing blade 37 may be a plate-like elastic member that has been bent to have an L-like shape. The plate-like elastic member may include, for example but not limited to, stainless steel. The developing blade 37 may be so disposed that the bent portion of the developing blade 37 comes into contact with the surface of the developing roller 36. The developing blade 37 may be also so disposed as to be pressed against the developing roller 36 by a predetermined pressing amount. The developing blade 37 may receive a layer forming voltage from the high voltage controller 67 which will be described later.

The feeding roller 38 may feed, to the developing roller 36, the toner stored in the toner container 22. The feeding roller 38 may be so disposed as to be in contact with a surface (a circumferential surface) of the developing roller 36. The feeding roller 38 may be so disposed as to be pressed against the developing roller 36 by a predetermined pressing amount. The feeding roller 38 may be rotated counterclockwise in this example by power transmitted from an unillustrated drum motor. Accordingly, friction may be generated between the surface of the feeding roller 38 and the surface of the developing roller 36 in each of the developing units 21. As a result, the toner may be electrically charged by so-called triboelectric effect in each of the developing units 21. The feeding roller 38 may receive a feeding voltage from the high voltage controller 67 which will be described later.

The exposure head 23 may apply light to the photosensitive drum 31. The exposure head 23 may include, for example but not limited to, a plurality of light-emitting diodes disposed side by side in a first scanning direction. The first scanning direction may be a depth direction in FIG. 2. The exposure head 23 may apply light to the photosensitive drum 31 on a dot-unit basis with the use of the light-emitting diodes. The photosensitive drum 31 may be thereby subjected to exposure by corresponding exposure head 23, which may allow for formation of an electrostatic latent image on the surface of the photosensitive drum 31.

The transfer belt section 40 may transfer the three toner images formed by the developing section 20 onto a transfer surface of the print medium 9. The transfer belt section 40 may be attachable to and detachable from the image forming apparatus 1.

Figure 3:
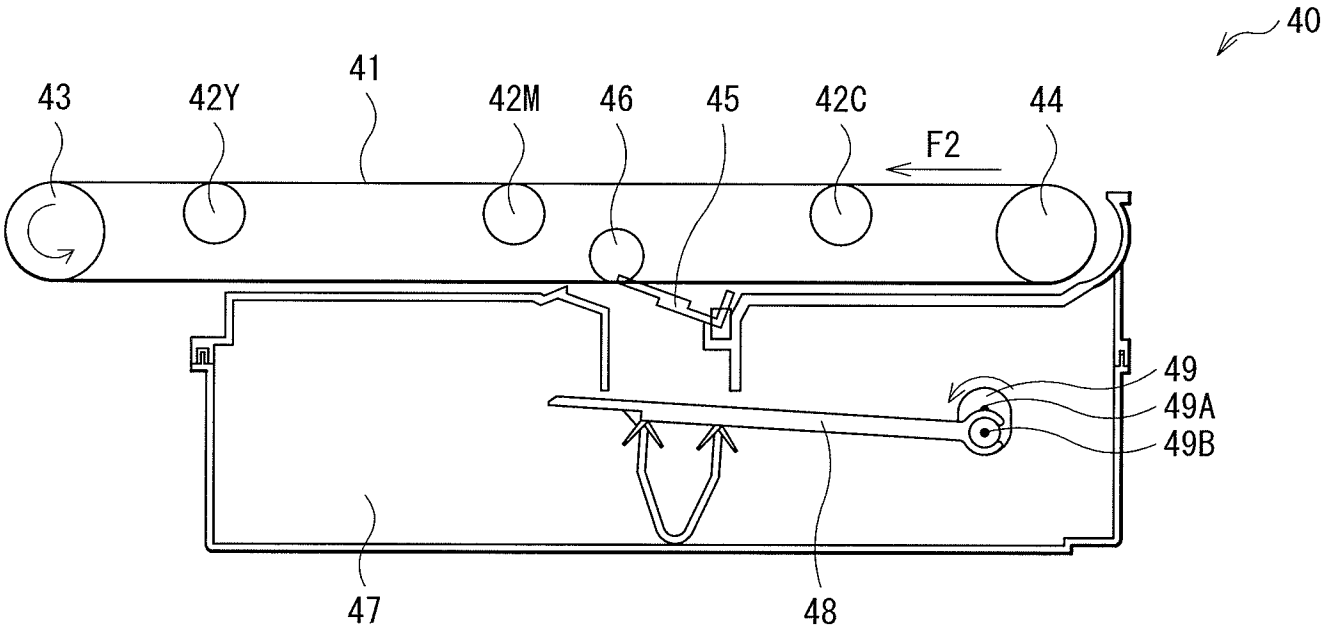
FIG. 3 is an explanatory diagram illustrating an example of a configuration of a transfer belt section illustrated in FIG. 1.

FIG. 3 illustrates an example of a configuration of the transfer belt section 40. The transfer belt section 40 may include a transfer belt 41, three transfer rollers 42, a driving roller 43, a tension roller 44, a belt cleaning blade 45, a roller 46, and a waste toner box 47. The three transfer rollers 42 may be a transfer roller 42C, a transfer roller 42M, and a transfer roller 42Y.

The transfer belt 41 may convey the print medium 9 along the conveyance path 8 in a conveyance direction F. The transfer belt 41 may lie on the driving roller 43 and the tension roller 44 while being stretched. The transfer belt 41 may be conveyed circularly in accordance with the rotation of the driving roller 43.

The transfer roller 42C may face the photosensitive drum 31 of the developing unit 21C with the conveyance path 8 and the transfer belt 41 in between. The transfer roller 42M may face the photosensitive drum 31 of the developing unit 21M with the conveyance path 8 and the transfer belt 41 in between. The transfer roller 42Y may face the photosensitive drum 31 of the developing unit 21Y with the conveyance path 8 and the transfer belt 41 in between. The transfer roller 42C, the transfer roller 42M, and the transfer roller 42Y may each receive a transfer voltage from the high voltage controller 67 which will be described later. Each of the toner images formed by the respective developing units 21 may be thereby transferred onto the transfer surface of the print medium 9 in the image forming apparatus 1.

The driving roller 43 may circularly convey the transfer belt 41. In this example, the driving roller 43 may be disposed downstream of the three developing units 21 in the conveyance direction F of the print medium 9B. The driving roller 43 may be rotated counterclockwise in this example by power transmitted from an unillustrated belt motor.

The tension roller 44 may allow the transfer belt 41 to be lain while being stretched. The tension roller 44 may be also rotated in accordance with the circular conveyance of the transfer belt 41. In this example, the tension roller 44 may be disposed upstream of the three developing units 21 in the conveyance direction F of the print medium 9B.

The belt cleaning blade 45 may scrape off the toner attached to the surface of the transfer belt 41 and thereby clean the surface of the transfer belt 41. The belt cleaning blade 45 may be disposed on a path different from the conveyance path 8 in a circular conveyance path of the transfer belt 41. The path on which the belt cleaning blade 45 is disposed may be a lower portion of the path illustrated in FIG. 3. The toner scraped off may be collected as a waste toner in the waste toner box 47.

The roller 46 may face the belt cleaning blade 45 with the transfer belt 41 in between. The roller 46 may so press the belt cleaning blade 45 against the surface of the transfer belt 41 that the belt cleaning blade 45 is in contact with the surface of the transfer belt 41.

The waste toner box 47 may contain a waste toner, i.e., a toner scraped off by the belt cleaning blade 45. The waste toner box 47 may include a stirring member 48 and a rotating member 49. The stirring member 48 may stir the waste toner and thereby level the waste toner. The stirring member 48 may thereby prevent the waste toner contained in the waste toner box 47 from gathering at a single location. One end of the stirring member 48 may be so coupled to a pivot axis 49B that the stirring member 48 is pivotable around the pivot axis 49B. The pivot axis 49B may be provided in the rotating member 49. The rotating member 49 may be rotated around a rotation axis 49A by power transmitted from an unillustrated belt motor. The pivot axis 49B, of the stirring member 48, provided in the rotating member 49 may be located at a position shifted from the rotation axis 49A of the rotating member 49. This configuration may cause the stirring member 48 to swing in response to the rotation of the rotating member 49 in the waste toner box 47. As a result, the collected waste toner may be stirred and leveled.

The density sensor 17 illustrated in FIG. 1 may detect density of the toner on the surface of the transfer belt 41. The density sensor 17 may be disposed upstream of the belt cleaning blade 45 on the circular conveyance path of the transfer belt 41 in this example. The density sensor 17 may detect, upon density correction operation, a density detection pattern formed on the transfer belt 41 by the developing section 20, for example. The image forming apparatus 1 may correct the toner density on the basis of a result of the detection performed by the density sensor 17.

The fixing section 50 may fix, to the print medium 9B, the toner image transferred on the print medium 9B, by applying heat and pressure to the print medium 9B. The fixing section 50 may include a heating roller 51 and a pressure applying roller 52. The heating roller 51 may include, for example, a heater such as a halogen lamp inside the heating roller 51. The heating roller 51 may apply heat to the toner on the print medium 9B, for example. The pressure applying roller 52 may be so disposed as to provide a pressure contact between the pressure applying roller 52 and the heating roller 51. The pressure applying roller 52 may apply pressure to the toner on the print medium 9B. The toner on the print medium 9B may be thereby heated, melted, and applied with pressure in the fixing section 50. As a result, the toner image may be fixed to the print medium 9B.

The discharge sensor 18 may detect discharging of the print medium 9B.

The discharging roller 19 may include a pair of rollers disposed with the conveyance path 8 in between. The discharging roller 19 may convey the print medium 9B toward outside of the image forming apparatus 1.

Figure 4:
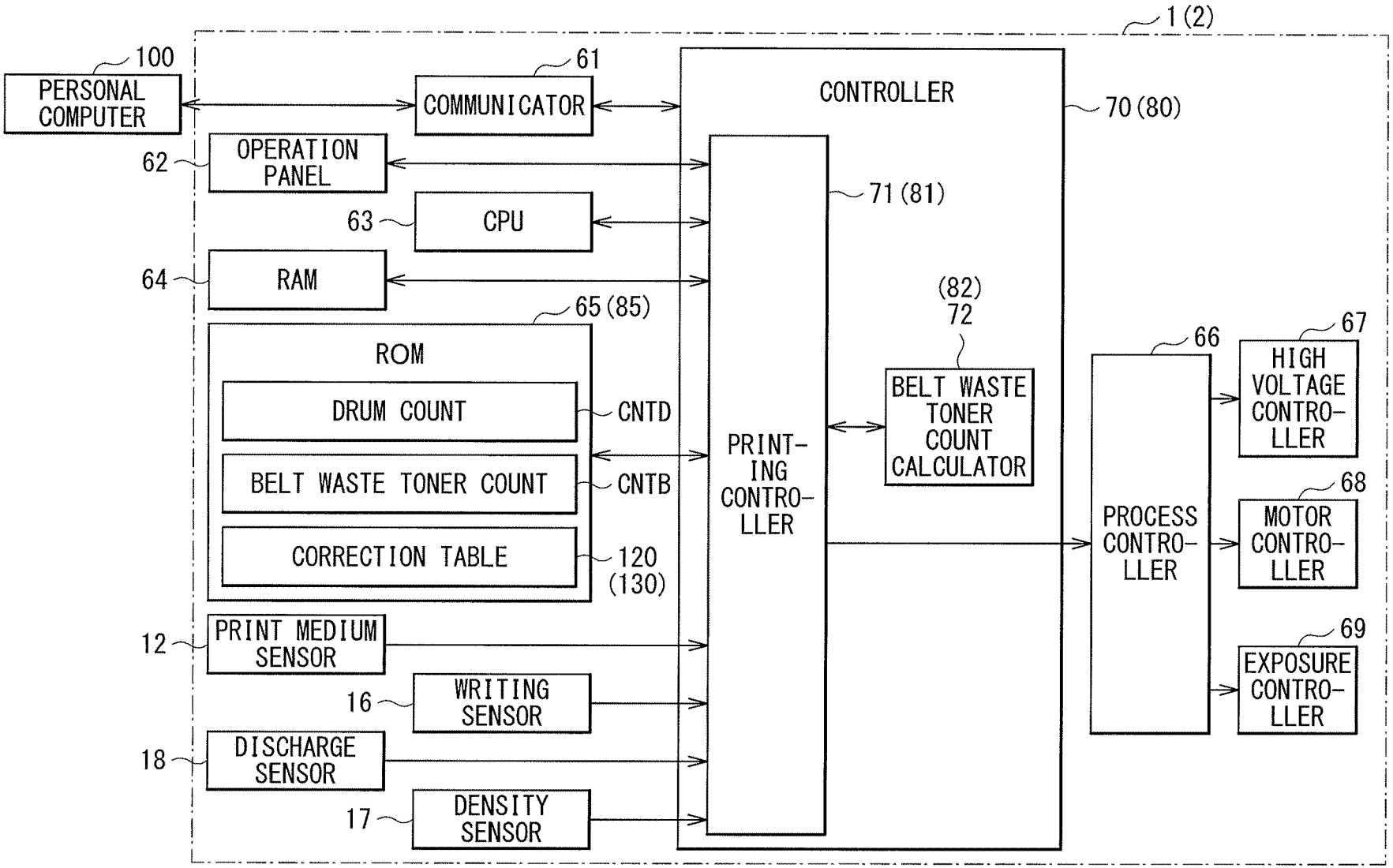
FIG. 4 is a block diagram illustrating an example of a control mechanism of an image forming apparatus illustrated in FIG. 1.

FIG. 4 illustrates an example of a control mechanism of the image forming apparatus 1. The image forming apparatus 1 may include a communicator 61, an operation panel 62, a central processing unit (CPU) 63, a random-access memory (RAM) 64, a read-only memory (ROM) 65, a controller 70, a process controller 66, the high voltage controller 67, a motor controller 68, and an exposure controller 69.

The communicator 61 may perform communication between the communicator 61 and a host device. The host device may be a personal computer 100 in this example. The communicator 61 may receive print data DP supplied from the personal computer 100. The print data DP may include a control command and image data. The print data DP may also include medium information or any other information. The medium information may include information related to a medium size of the cut print medium 9B, information related to a medium number of the print medium 9B to be subjected to printing, information related to a medium type of the print medium 9B, and information related to a medium thickness of the print medium 9B. The medium number of the print medium 9B may be, for example but not limited to, number of sheets of the print medium 9B. The communicator 61 may be coupled to the personal computer 100, for example but not limited to, via a network such as a local area network (LAN) or via an interface such as a universal serial bus (USB).

The operation panel 62 may receive operation performed by a user. The operation panel 62 may display information such as an operation state of the image forming apparatus 1. The operation panel 62 may include, for example but not limited to, devices such as a touch panel, various buttons, a liquid crystal display, or various indicators.

The CPU 63 may control operation of the image forming apparatus 1 by executing a control program. The CPU 63 may serve as a main controller of the image forming apparatus 1.

The RAM 64 may temporarily hold data to be used when the CPU 63 executes the control program.

The ROM 65 may be a re-writable flash memory. The ROM 65 may hold the control program to be executed by the CPU 63. The ROM 65 may also hold a drum count CNTD, a belt waste toner count CNTB, and a correction table 120.

The drum count CNTD may indicate an accumulative use amount of each of the photosensitive drums 31 of the respective three developing units 21. The controller 70 may count up the drum count CNTD by one count each time a rotation distance of the photosensitive drum 31 based on the outer circumference of the photosensitive drum 31 reaches a predetermined distance while the image forming apparatus 1 performs image formation operation on the basis of the print data DP. The predetermined distance may be set on the basis of the length of the print medium 9, for example. The drum count CNTD may be reset upon replacement of the developing unit 21. The image forming apparatus 1 may give notification that the developing unit 21 has reached the end of its life when the drum count CNTD reaches a predetermined threshold.

The belt waste toner count CNTB may indicate an accumulative collection amount of the waste toner collected in the waste toner box 47 of the transfer belt section 40. When the image forming apparatus 1 performs the image formation operation on the basis of the print data DP, the controller 70 may calculate a count ΔCNTB of the waste toner to be collected in the waste toner box 47 in the relevant print job, and update the belt waste toner count CNTB with the use of the ΔCNTB. The belt waste toner count CNTB may reset upon replacement of the transfer belt section 40. The image forming apparatus 1 may give notification that the transfer belt section 40 has reached the end of its life when the belt waste toner count CNTB reaches a predetermined threshold.

The correction table 120 may be referred to when a belt waste toner count calculator 72 of the controller 70 calculates the count ΔCNTB of the waste toner to be collected. The belt waste toner count calculator 72 will be described later. The correction table 120 may include information related to a correction parameter S associated with the medium size of the cut print medium 9B.

In the image forming apparatus 1, the toner may be attached to the transfer belt 41 for various reasons. The toner attached to the transfer belt 41 may be scraped off by the belt cleaning blade 45 and collected, as the waste toner, in the waste toner box 47. One of the reasons why the toner is attached to the transfer belt 41 may be due to a gray background toner.

In the image forming apparatus 1, a negatively-charged toner may move from the developing roller 36 onto a portion, of the surface of the photosensitive drum 31, subjected to exposure by the exposure head 23. The above-described moving of the negatively-charged toner may be caused by electrostatic force. A toner image may be thereby formed on the photosensitive drum 31. In some cases, a toner that is negatively charged but has a low charge amount or a positively-charged toner may be present on the developing roller 36. In such cases, the toner that is negatively charged but has a low charge amount or the positively-charged toner may move from the developing roller 36 onto a portion, of the surface of the photosensitive drum 31, not subjected to exposure. The toner that is negatively charged but has a low charge amount or the positively-charged toner described above may be referred to as the "gray background toner". A region, of the surface of the photosensitive drum 31, other than a region corresponding to the print medium 9B may not be subjected to exposure by the exposure head 23. Hereinafter, the region, of the surface of the photosensitive drum 31, corresponding to the print medium 9B may be referred to as a "print-medium region", and the region, of the surface of the photosensitive drum 31, other than the print-medium region may be referred to as a "non-print-medium region". A normal toner that is negatively charged may therefore not be attached to the non-print-medium region; however, the gray background toner can be attached to the non-print-medium region.

When the image forming apparatus 1 transfers the toner image formed on the photosensitive drum 31 onto the print medium 9B, the toner present on the print-medium region may move onto the print medium 9B, and the toner present on the non-print-medium region may move onto the transfer belt 41. As a result, the gray background toner may move onto the transfer belt 41. The gray background toner moved onto the transfer belt 41 may be scraped off by the belt cleaning blade 45 and collected in the waste toner box 47. Accordingly, the greater the area of the non-print-medium region is, the greater the amount of the gray background toner collected in the waste toner box 47 may become. In this example, the controller 70 may calculate the amount of the gray background toner to be collected in the waste toner box 47 with the use of the correction parameter S. The correction parameter S may indicate an area ratio of the non-print-medium region to an image formable region of the surface of the photosensitive drum 31.

Figure 5:
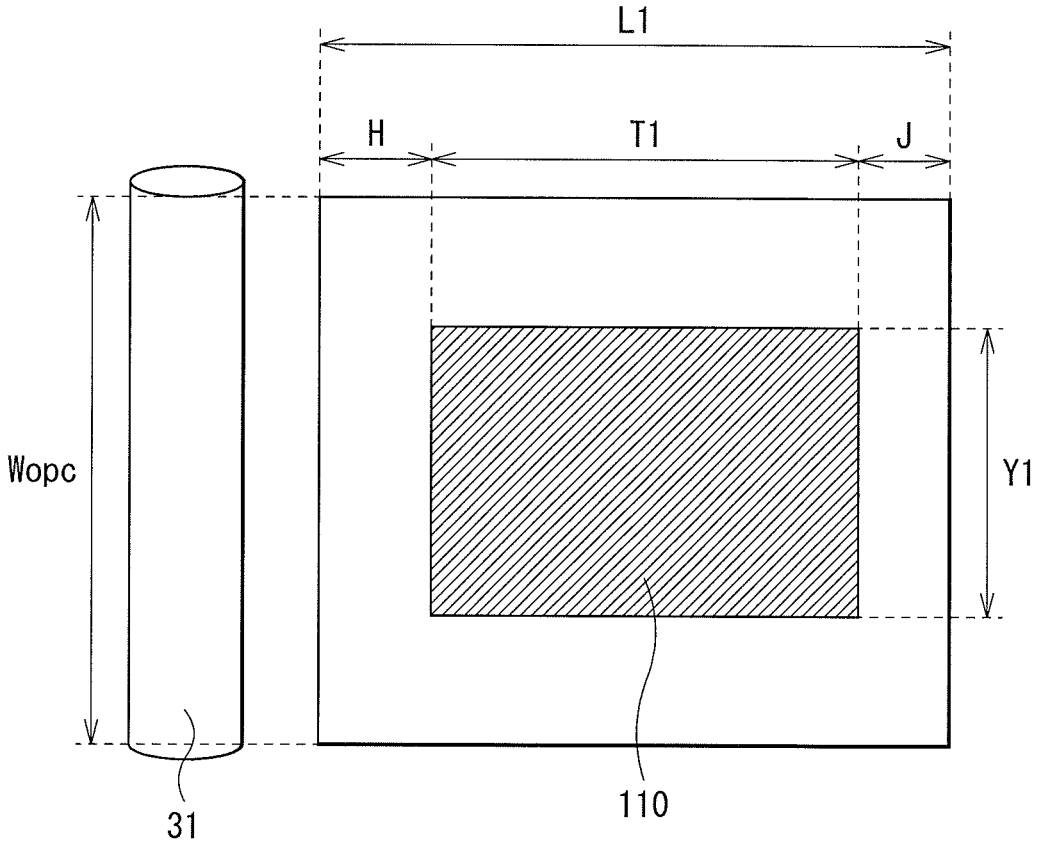
FIG. 5 is an explanatory diagram illustrating an example of an image formable region of a surface of a photosensitive drum according to one example embodiment.

FIG. 5 illustrates the image formable region of the surface of the photosensitive drum 31 in a case where an image is to be formed on a single sheet of the print medium 9B in a single print job. A region 110 in FIG. 5 may correspond to the print-medium region.

In image forming apparatus 1, the cut print medium 9B may be once made to wait before the developing unit 21C which is located most upstream of the three developing units 21. Thereafter, the photosensitive drum 31 of each of the three developing units 21 may start rotating in response to the start of the operation of the drum motor, and the transfer belt 41 may start conveying the print medium 9B. The toner image on the photosensitive drum 31 of each of the three developing units 21 may be transferred onto the print medium 9B. When a predetermined time period elapses from timing at which a rear end of the print medium 9B passes the developing unit 21Y, the drum motor may stop operating and the photosensitive drum 31 of each of the three developing units 21 may stop rotating. The developing unit 21Y may be located most downstream of the three developing units 21.

A rotation distance L1 may be expressed by the following expression, where the rotation distance L1 is the rotation distance of the photosensitive drum 31, based on the outer circumference of the photosensitive drum 31, from the start of the rotation of the photosensitive drum 31 to the end of the rotation of the photosensitive drum 31 as described above.

$$L1=H+T1+J \quad \text{(EQ1)}$$

In the expression above, "H" may be a distance from the front end of the print medium 9B to a position of the photosensitive drum 31 of the developing unit 21C at the time when the cut print medium 9B is made to wait before the developing unit 21C. The developing unit 21C may be located most upstream of the three developing units 21. "J" may be a distance from the rear end of the print medium 9B to a position of the photosensitive drum 31 of the developing unit 21Y at the time when the photosensitive drum 31 stops rotating. The developing unit 21Y may be located most downstream of the three developing units 21. The distance H and the distance J may each be a fixed value and may not vary depending on the medium size of the print medium 9B. "T1" may be a medium length of the print medium 9B.

A rotation area Xopc may be expressed by the following expression, where the rotation area Xopc may be the area of the image formable region of the surface of the photosensitive drum 31.

$$Xopc=Wopc\times L1 \quad \text{(EQ2)}$$

In the expression above, Wopc is an effective width in a longitudinal direction of the photosensitive drum 31, i.e., the first scanning direction. The effective width may be a width within which an image is allowed to be formed.

The area X1 of the region 110 corresponding to the print medium 9B may be expressed by the following expression.

$$X1=Y1\times T1 \quad \text{(EQ3)}$$

In the expression above, X1 is a medium width of the print medium 9B.

The correction parameter S may be an area ratio of the non-print-medium region to the image formable region of the surface of the photosensitive drum 31. In other words, the correction parameter S may be expressed by the following expression.

$$S=(Xopc-X1)/Xopc \quad \text{(EQ4)}$$

A numerical value of the correction parameter S may be obtained by substituting a value of the rotation area Xopc calculated with the expression EQ2 to Xopc in the expression EQ4 and substituting a value of the area X1 calculated with the expression EQ3 to Xopc in the expression EQ4. The value of the correction parameter S may be smaller as the area X1 which is the medium size is greater.

FIG. 6 illustrates an example of a configuration of the correction table 120. The correction table 120 may include the correction parameters S for various medium sizes each expressed with the medium width Y1 and the medium length T1. In this example, the medium width Y1 may be classified into five ranges, and the medium length T1 may be classified into six ranges. The correction table 120 may be created with the use of the expression EQ4 and stored in the ROM 65 in advance. The belt waste toner count calculator 72 of the controller 70 may acquire the correction parameter S on the basis of the medium size of the print medium 9B by means of the correction table 120. The belt waste toner count calculator 72 will be described later. The medium size of the print medium 9B may be expressed with the medium width Y1 and the medium length T1. Further, the belt waste toner count calculator 72 may calculate, with the use of the acquired correction parameter S, the count ΔCNTB of the waste toner to be collected in the waste toner box 47 in the relevant print job.

The controller 70 may control the operation of the image forming apparatus 1 on the basis of an instruction given from the CPU 63. The controller 70 may include a printing controller 71 and the belt waste toner count calculator 72.

The printing controller 71 may control printing operation of the image forming apparatus 1. The printing controller 71 may be coupled to each of the operation panel 62, the CPU 63, the RAM 64, and the ROM 65. The printing controller 71 may give an instruction to the process controller 66 on the basis of a result of detection performed by each of the print medium sensor 12, the writing sensor 16, the discharge sensor 18, and the density sensor 17. The printing controller 71 may also supply the belt waste toner count calculator 72 with the information related to the medium size included in the print data DP.

The belt waste toner count calculator 72 may calculate, on the basis of the print data DP, the count ΔCNTB of the waste toner to be collected in the waste toner box 47 in the relevant print job. The count ΔCNTB may be expressed by the following expression.

$$\Delta CNTB = \Delta CNTB0 + \Delta CNTBbg \quad \text{(EQ5)}$$

In the expression above, ΔCNTB0 may be, for example but not limited to, a count of the toner that is to be used in various processes directed to maintaining of print qualities and collected in the waste toner box 47. Non-limiting examples of the foregoing various processes may include density correction and color shift correction. ΔCNTBbg may be a count of the gray background toner that is to move from the photosensitive drum 31 onto the transfer belt 41 and to be collected in the waste toner box 47. The count ΔCNTBbg may be expressed by the following expression.

$$\Delta CNTBbg = \Delta CNTBbg0 \times S \quad \text{(EQ6)}$$

In the expression above, ΔCNTBbg0 is a count of the gray background toner that is to be collected in a case based on an assumption that the gray background toner has moved onto the transfer belt 41 from all of the image formable region of the surface of the photosensitive drum 31. The count ΔCNTBbg0 may be calculated also in consideration of, for example but not limited to, an environment condition such as a temperature or humidity. The count ΔCNTB, the count ΔCNTB0, the count ΔCNTBbg, and the count ΔCNTBbg0 may each be set as, for example but not limited to, a total value of the counts related to the three colors of toners.

The belt waste toner count calculator 72 may calculate the count ΔCNTB with the use of the expressions EQ5 and EQ6. The count ΔCNTB may be the count of the waste toner to be collected in the waste toner box 47 in the relevant print job. Upon calculation of the count ΔCNTB, the belt waste toner count calculator 72 may acquire the correction parameter S on the basis of the medium size of the print medium 9B by means of the correction table 120, and calculate, with the use of the acquired correction parameter S, the count ΔCNTB of the waste toner to be collected. The medium size may be expressed with the medium width Y1 and the medium length T1. The correction table 120 may be stored in the ROM 65. Further, the controller 70 may add the count ΔCNTB to the belt waste toner count CNTB stored in the ROM 65. Further, the controller 70 may write a result of the addition as the belt waste toner count CNTB on the ROM 65. The controller 70 may thereby update the belt waste toner count CNTB.

The process controller 66 may control operation of each of the high voltage controller 67, the motor controller 68, and the exposure controller 69 on the basis of an instruction given from the printing controller 71 of the controller 70.

The high voltage controller 67 may generate, on the basis of an instruction given from the process controller 66: the developing voltage to be applied to each of the three developing rollers 36; the charging voltage to be applied to each of the three charging rollers 34; the layer forming voltage to be applied to each of the three developing blades 37; the feeding voltage to be applied to each of the three feeding rollers 38; and the transfer voltage to be applied to each of the three transfer rollers 42.

The motor controller 68 may control, on the basis of an instruction given from the process controller 66, operation of various motors including the conveying motor, the cutter motor, the drum motor, and the belt motor.

The exposure controller 69 may control exposure operation of each of the three exposure heads 23 on the basis of an instruction given from the process controller 66.

The developing unit 21 may correspond to a "developing unit" in one specific but non-limiting embodiment of the technology. The photosensitive drum 31 may correspond to an "image carrier" in one specific but non-limiting embodiment of the technology. The transfer belt section 40 may correspond to a "transfer section" in one specific but non-limiting embodiment of the technology. The belt cleaning blade 45 may correspond to a "cleaning member" in one specific but non-limiting embodiment of the technology. The waste toner box 47 may correspond to a "container" in one specific but non-limiting embodiment of the technology. The controller 70 may correspond to a "calculator" in one specific but non-limiting embodiment of the technology. The ROM 65 may correspond to a "storage device" in one specific but non-limiting embodiment of the technology. The belt waste toner count CNTB may correspond to a "collection amount" in one specific but non-limiting embodiment of the technology.

Example Operation and Example Workings

A description is given below of example operation and example workings of the image forming apparatus 1 according to the first example embodiment.

[Outline of General Operation]

A description is given first of an outline of general operation of the image forming apparatus 1 with reference to FIGS. 1 and 4. When the communicator 61 receives the print data DP supplied from the personal computer 100, the printing controller 71 may give an instruction to the process controller 66 on the basis of the received print data DP. The process controller 66 may control operation of each of the high voltage controller 67, the motor controller 68, and the exposure controller 69 on the basis of an instruction given from the printing controller 71 of the controller 70. The high voltage controller 67 may generate, on the basis of an instruction given from the process controller 66: the developing voltage to be applied to each of the three developing rollers 36; the charging voltage to be applied to each of the three charging rollers 34; the layer forming voltage to be applied to each of the three developing blades 37; the feeding voltage to be applied to each of the three feeding rollers 38; and the transfer voltage to be applied to each of the three transfer rollers 42. The motor controller 68 may control, on the basis of an instruction given from the process controller 66, operation of various motors including the conveying motor, the cutter motor, the drum motor, and the belt motor. The exposure controller 69 may control exposure operation of each of the three exposure heads 23 on the basis of an instruction given from the process controller 66.

The cutter 14A of the cutter section 14 may cut the print medium 9 fed from the print medium holder 11. The three developing units 21 of the developing unit 21 may form the respective toner images of the three colors, e.g., the cyan toner image, the magenta toner image, and the yellow toner image. The transfer belt section 40 may convey the cut print medium 9B along the conveyance path 8, and transfer, onto the print medium 9B, the toner images on the respective photosensitive drums 31 of the three developing units 21. The fixing section 50 may fix, to the print medium 9B, the toner image transferred onto the print medium 9B. The discharging roller 19 may convey the print medium 9B toward outside of the image forming apparatus 1.

[Detailed Operation]

In the transfer belt section 40, the belt cleaning blade 45 may scrape off the toner attached to the transfer belt 41. The toner scraped off may be collected in the waste toner box 47 as the waste toner. The image forming apparatus 1 may calculate the count ΔCNTB and update the belt waste toner count CNTB with the use of the calculated count ΔCNTB, each time the print data DP is supplied. The count ΔCNTB may correspond to the amount of the waste toner to be collected in the waste toner box 47 in the relevant print job. Further, the image forming apparatus 1 may give, on the basis of the belt waste toner count CNTB, notification that the transfer belt section 40 has reached the end of its life. This operation is described in detail below.

Figure 7:
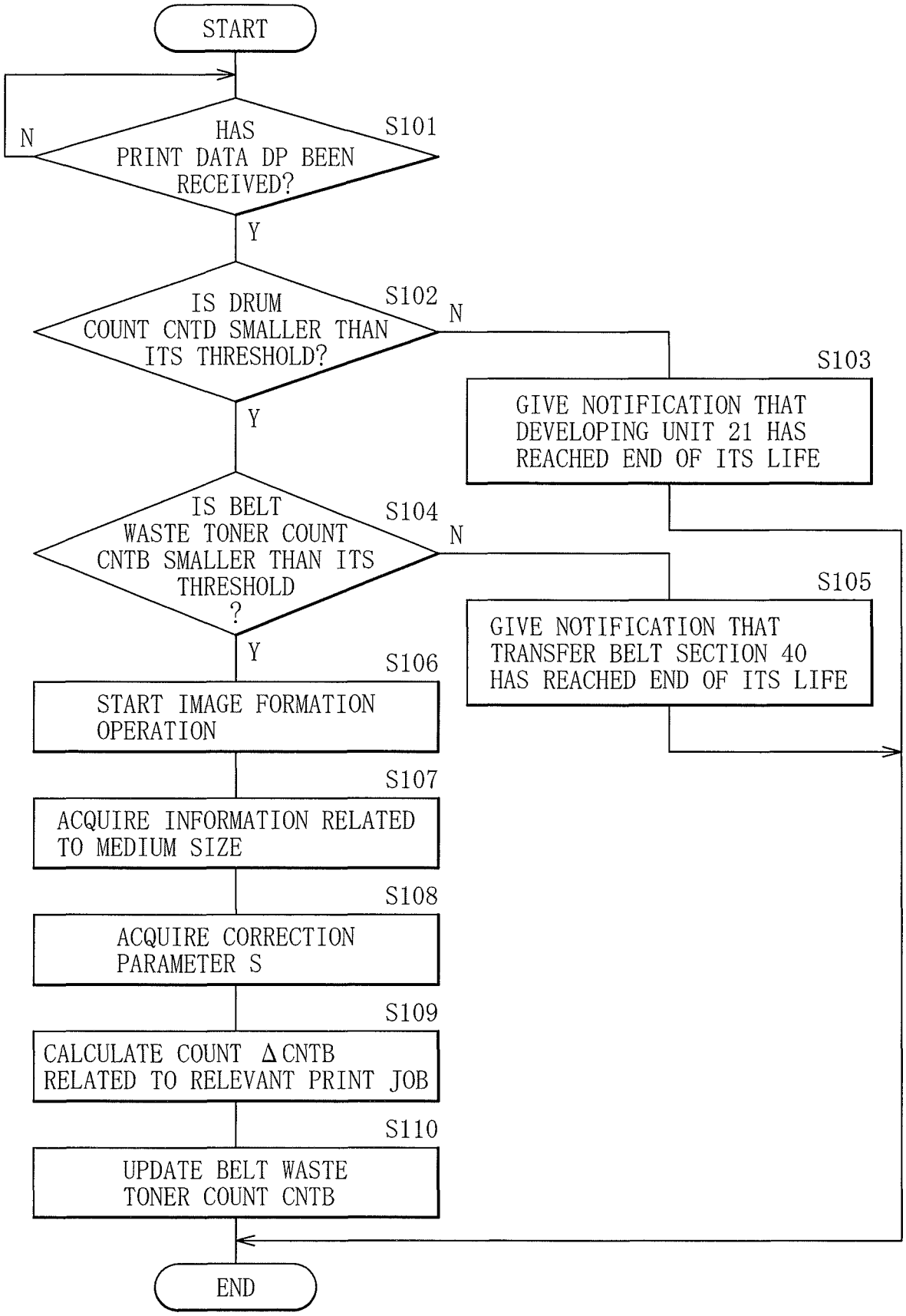
FIG. 7 is a flowchart illustrating an example of operation of an image forming apparatus according to one example embodiment.

FIG. 7 illustrates an example of operation of the image forming apparatus 1 of updating the belt waste toner count CNTB. In this example, the image forming apparatus 1 may perform the image formation operation on the basis of the print data DP including image data corresponding to a single sheet. Each time the image forming apparatus 1 receives the print data DP, the image forming apparatus 1 may confirm whether each of the drum count CNTD and the belt waste toner count CNTB is smaller than its threshold. When each of the drum count CNTD and the belt waste toner count CNTB is smaller than its threshold, the image forming apparatus 1 may start the image formation operation. When each of the drum count CNTD and the belt waste toner count CNTB is smaller than its threshold, the image forming apparatus 1 may also calculate the count ΔCNTB related to the relevant print job and update the belt waste toner count CNTB with the use of the calculated count ΔCNTB. This operation is described in detail below.

First, the controller 70 may confirm whether the communicator 61 has received the print data DP (step S101). The controller 70 may repeatedly perform the process in step S101 until the communicator 61 receives the print data DP.

When the communicator 61 has received the print data DP in step S101 ("Y" in step S101), the printing controller 71 may confirm whether the drum count CNTD stored in the ROM 65 is smaller than its threshold (step S102). When the drum count CNTD is equal to or greater than its threshold ("N" in step S102), the operation panel 62 may give, on the basis of an instruction given from the printing controller 71, notification that the developing unit 21 has reached the end of its life (step S103). This may bring the flow to an end.

When the drum count CNTD stored in the ROM 65 is smaller than its threshold in step S102 ("Y" in step S102), the printing controller 71 may confirm whether the belt waste toner count CNTB stored in the ROM 65 is smaller than its threshold (step S104). When the belt waste toner count CNTB is equal to or greater than its threshold ("N" in step S104), the operation panel 62 may give, on the basis of an instruction given from the printing controller 71, notification that the transfer belt section 40 has reached the end of its life (step S105). This may bring the flow to an end.

When the belt waste toner count CNTB stored in the ROM 65 is smaller than its threshold in step S104 ("Y" in step S104), the image forming apparatus 1 may start the image formation operation on the basis of the print data DP (step S106). For example, the printing controller 71 may give an instruction to the process controller 66 on the basis of the print data DP. The process controller 66 may instruct, on the basis of an instruction given from the printing controller 71 of the controller 70, each of the high voltage controller 67, the motor controller 68, and the exposure controller 69 to start operating.

Thereafter, the belt waste toner count calculator 72 may acquire information related to the medium size of the print medium 9B included in the print data DP (step S107). The medium size of the print medium 9B may be expressed with the medium width Y1 and the medium length T1.

Thereafter, the belt waste toner count calculator 72 may acquire the correction parameter S on the basis of the information related to the medium size of the print medium 9B expressed with the medium width Y1 and the medium length T1 (step S108). For example, the belt waste toner count calculator 72 may acquire the correction parameter S by means of the correction table 120 on the basis of the information related to the medium size of the print medium 9B acquired in step S107. The correction table 120 may be stored in the ROM 65. The medium size of the print medium 9B may be expressed with the medium width Y1 and the medium length T1.

Thereafter, the belt waste toner count calculator 72 may calculate the count ΔCNTB of the waste toner to be collected in the waste toner box 47 in the relevant print job (step S109). For example, the belt waste toner count calculator 72 may calculate the count ΔCNTB with the use of the correction parameter S acquired in step S108, the expression EQ5, and the expression EQ6.

Thereafter, the controller 70 may update the belt waste toner count CNTB stored in the ROM 65 (step S110). For example, the belt waste toner count calculator 72 may add the count ΔCNTB to the belt waste toner count CNTB stored in the ROM 65. Further, the printing controller 71 may write, on the ROM 65, the belt waste toner count CNTB after the addition. The controller 70 may thus update the belt waste toner count CNTB stored in the ROM 65.

This may bring the flow to the end.

A description is given below of comparison between an actually-measured value of a remaining containable amount R of the waste toner box 47 and a calculated value of the remaining containable amount R of the waste toner box 47.

FIG. 8 illustrates an example of a result of an experiment related to a containable amount Rmeas and a containable amount Rcal. The containable amount Rmeas is the actually-measured value of the containable amount R. The containable amount Rcal is the calculated value of the containable amount R. In this experiment, a print job that formed an image on a single sheet of the print medium 9B on the basis of image data having a duty ratio of 0 (zero) % was performed for a plurality of times until a conveyance distance of the transfer belt 41 reached a predetermined distance corresponding to the life of the transfer belt 41. The containable amount Rmeas is the remaining containable amount R that is obtained by subtracting, from the maximum containable amount of the waste toner box 47, the amount of waste toner actually collected in the waste toner box 47. The containable amount Rcal is a remaining containable amount R obtained on the basis of the count ΔCNTB (the belt waste toner count CNTB) calculated by the belt waste toner count calculator 72. The containable amount Rmeas and the containable amount Rcal may each be expressed by a ratio with respect to the maximum containable amount of the waste toner box 47.

The experiment was conducted with the use of the print medium 9B having various medium sizes under three environment conditions NN, HH, and LL. The medium sizes of the print medium 9B were each expressed with the medium width Y1 and the medium length T1. The environment condition NN involved temperature of 22° C. and humidity of 55%. The environment condition HH involved temperature of 27° C. and humidity of 80%. The environment condition LL involved temperature of 19° C. and humidity of 20%. "○ (circle)" in a determination field in the table illustrated in FIG. 8 indicates that a difference between the containable amount Rmeas, i.e., the actually-measured value of the containable amount R and the containable amount Rcal, i.e., the calculated value of the containable amount R was equal to or smaller than 10%.

As can be seen from FIG. 8, the image forming apparatus 1 may allow an absolute value of the difference between the containable amount Rmeas, i.e., the actually-measured value of the containable amount R, and the containable amount Rcal, i.e., the calculated value of the containable amount R, to be equal to or smaller than 10% for various medium sizes and various environment conditions.

As described above, in the image forming apparatus 1, the belt waste toner count calculator 72 may determine the count ΔCNTB (the belt waste toner count CNTB) with the use of the correction parameter S based on the medium size. This improves accuracy of calculation of the belt waste toner count CNTB compared to that in a case where the correction parameter S is not varied on the basis of the medium size.

In a case where the correction parameter S is not varied on the basis of the medium size, the accuracy of calculation of the belt waste toner count CNTB can be lower. FIG. 9 illustrates an example of a result of an experiment in a case where the correction parameter S is not varied on the basis of the medium size. "○ (circle)" in a determination field in the table illustrated in FIG. 9 indicates that a difference between the containable amount Rmeas, i.e., the actually-measured value of the containable amount R, and the containable amount Rcal, i.e., the calculated value of the containable amount R, was equal to or smaller than 10%, and "x (cross)" in the determination field in the table illustrated in FIG. 9 indicates that the difference between the containable amount Rmeas and the containable amount Rcal was greater than 10%. In this example, the print medium 9B was assumed to have the medium width Y1 of 58 mm and the medium length T1 of 216 mm. As can be seen from FIG. 9, an absolute value of the difference between the containable amount Rmeas, i.e., the actually-measured value of the containable amount R, and the containable amount Rcal, i.e., the calculated value of the containable amount R, is greater than 10% in many of the cases where the correction parameter S is not varied on the basis of the medium size. In such a case where the accuracy of calculation of the belt waste toner count CNTB is lower, for example, notification that the transfer belt section 40 has reached the end of its life described in step S105 in FIG. 7 may be given earlier or later than appropriate timing. For example, in a case where the notification is given earlier than the appropriate timing, the notification may be given regardless of the fact that the waste toner box 47 still has room. This can cause the user to bear a burden of replacing the transfer belt section 40 or a monetary burden. For example, in a case where the notification is given later than the appropriate timing, the waste toner box 47 may contain an excessive amount of the waste toner. This can cause the waste toner box 47 to be full. In a case where a threshold on the basis of which determination related to the life is performed is set lower to avoid causing the waste toner box 47 to be full as described above, the notification may be given earlier than the appropriate timing. This can also cause the user to bear the burden of replacing the transfer belt section 40 or the monetary burden as a result.

In contrast, in the image forming apparatus 1, the belt waste toner count calculator 72 may calculate the count ΔCNTB (the belt waste toner count CNTB) with the use of the correction parameter S based on the medium size. Therefore, the accuracy of calculation of the belt waste toner count CNTB is improved also in a case where the medium size is varied. As a result, for example, the image forming apparatus 1 may be able to give notification that the transfer belt section 40 has reached the end of its life may be given at appropriate timing. The image forming apparatus 1 thereby reduces the possibility of causing the user to bear the burden of replacing the transfer belt section 40 or the monetary burden, which reduces the possibility of causing the waste toner box 47 to be full.

[Example Effects]

According to the first example embodiment described above, the count ΔCNTB (a belt waste toner count) may be calculated with the use of a correction parameter based on a medium size. Therefore, it is possible to improve accuracy of calculation of the belt waste toner count also in a case where the medium size of a print medium to be subjected to printing is varied. As a result, it is possible to, for example, give notification that a transfer belt section has reached the end of its life at appropriate timing.

Modification Example 1-1

In the first example embodiment described above, the belt waste toner count calculator 72 may acquire the correction parameter S on the basis of the medium size of the print medium 9B by means of the correction table 120. The medium size of the print medium 9B may be expressed with the medium width Y1 and the medium length T1. The correction table 120 may be stored in the ROM 65. However, this is non-limiting. In an alternative example, the correction parameter S may be calculated on the basis of the medium size of the print medium 9B with the use of the expression EQ4 without providing the correction table 120.

Modification Example 1-2

In the first example embodiment described above, the belt waste toner count calculator 72 may calculate the count ΔCNTB on the basis of the information related to the medium size included in the print data DP. However, this is non-limiting. In an alternative example, the belt waste toner count calculator 72 may calculate the count ΔCNTB on the basis of the information related to the medium size set in the image forming apparatus 1. In another example, the image forming apparatus 1 may be provided with a sensor that detects the medium size of the print medium 9B. In this case, the belt waste toner count calculator 72 may calculate the count ΔCNTB on the basis of the medium size detected by the provided sensor.

2. Second Example Embodiment

A description is given below of an image forming apparatus 2 according to a second example embodiment. According to the second example embodiment, the correction parameter S may be calculated on the basis of a medium number, e.g., the number of sheets, in addition to the medium size. It is to be noted that component parts that are substantially the same as those of the image forming apparatus 1 according to the first example embodiment described above are denoted with the same numerals and may not be described further where appropriate.

As illustrated in FIG. 4, the image forming apparatus 2 may include a ROM 85 and a controller 80.

The ROM 85 may hold a correction table 130. The correction table 130 may include information related to the correction parameter S associated with the medium size of the cut print medium 9B and the medium number, e.g., the number of sheets, of the print medium 9B to be subjected to printing.

Figure 10:
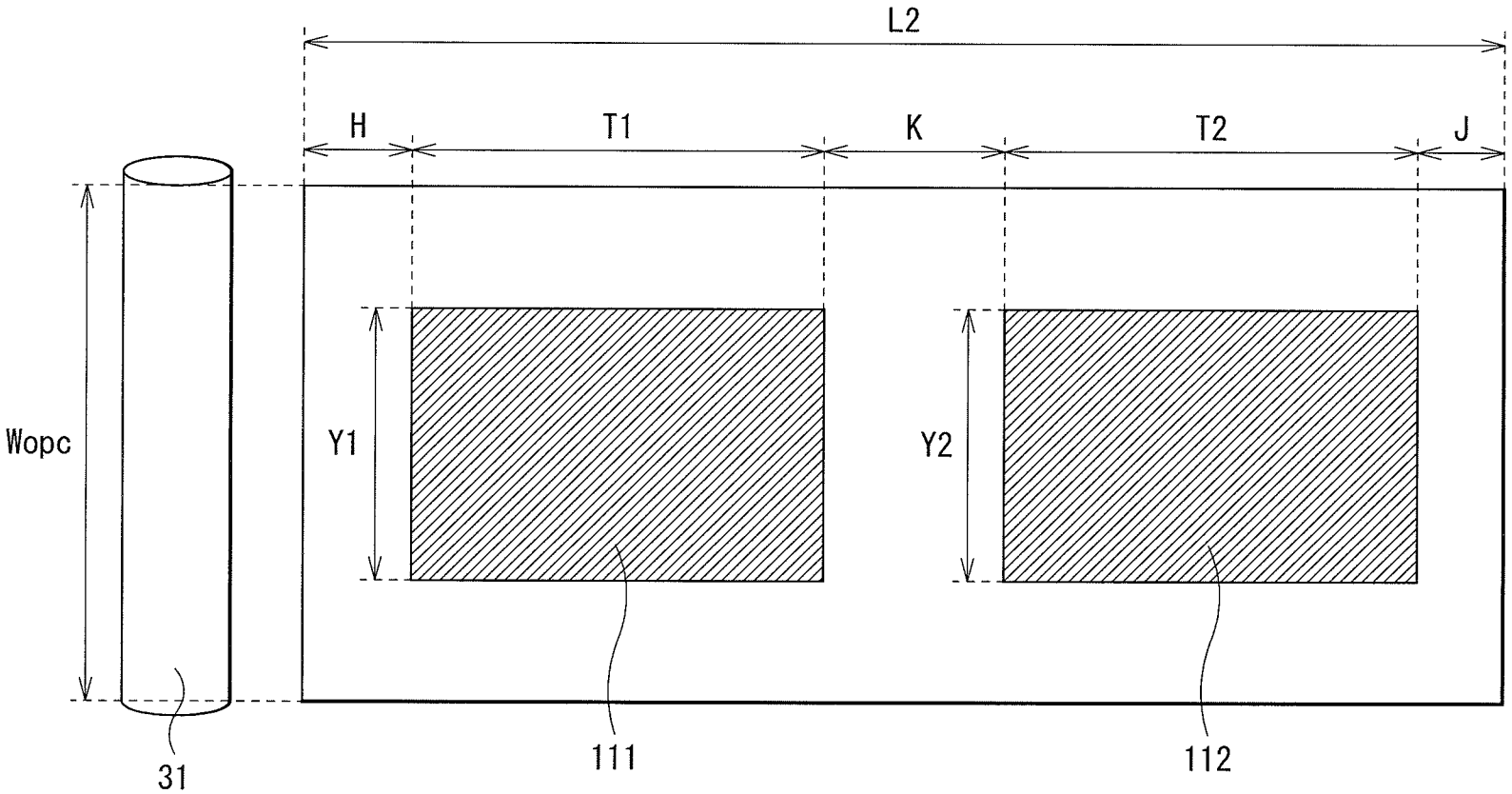
FIG. 10 is an explanatory diagram illustrating an example of an image formable region of a surface of a photosensitive drum according to one example embodiment.

FIG. 10 illustrates an image formable region of the surface of the photosensitive drum 31 in a case where images are to be formed on a plurality of print media 9B in a single print job. In this example, images may be formed on two sheets of the print media 9B. In FIG. 10, a region 111 may correspond to the first sheet of the print medium 9B, and a region 112 may correspond to the second sheet of the print medium 9B.

A rotation distance L2 may be expressed by the following expression, where the rotation distance L2 is the rotation distance of the photosensitive drum 31, based on the outer circumference of the photosensitive drum 31, from the start of rotation of the photosensitive drum 31 to the end of the rotation of the photosensitive drum 31.

$$L2=H+T1+K+T2+J \quad \text{(EQ7)}$$

In the expression above, "T1" is a medium length of the first sheet of the print medium 9B. "T2" is a medium length of the second sheet of the print medium 9B. "K" is a distance from a rear end of the first sheet of the print medium 9B to a front end of the second sheet of the print medium 9B.

A rotation area X2*opc* may be expressed by the following expression, where the rotation area X2*opc* may be the area of the image formable region of the surface of the photosensitive drum 31.

$$X2opc=Wopc\times L2=Wopc\times(H+T1+K+T2+J) \quad \text{(EQ8)}$$

For example, in a case where images are to be formed on n-number of sheets of the print media 9B having the same medium length T1, a rotation distance Ln may be expressed by the following expression.

$$Ln=H+n\times T1+(n-1)\times K+J \quad \text{(EQ9)}$$

Accordingly, the rotation area Xnopc in this case may be expressed by the following expression.

$$Xnopc=Wopc\times Ln=Wopc\times(H+n\times T1+(n-1)\times K+J) \quad \text{(EQ10)}$$

A total area Xn of the areas of the regions corresponding to the respective plurality of print media 9B may be expressed by the following expression.

$$Xn=\Sigma(Yn\times Tn) \quad \text{(EQ11)}$$

In the expression above, "Yn" is a medium width of the n-th sheet of the print medium 9B. "Tn" is a medium length of the n-th sheet of the print medium 9B.

The correction parameter S may be expressed by the following expression.

$$S=(Xnopc-Xn)/Xnopc \quad \text{(EQ12)}$$

The numerical value of the correction parameter S in a case where images are to be formed on the n-number of sheets of the print media 9B may be obtained by substituting the rotation area Xnopc calculated with the expression EQ10 and the total area Xn calculated with the expression EQ11 for Xnopc and Xn in the expression EQ12 described above, respectively.

FIGS. 11A to 11C may each illustrate an example of a configuration of the correction table 130. In this example, the correction table 130 may include three correction tables, i.e., a correction table 130A, a correction table 130B, and a correction table 130C. The correction table 130A may be used in a case where images are to be formed on three sheets of the print media 9B in a single print job (n=3). The correction table 130B may be used in a case where images are to be formed on five sheets of the print media 9B in a single print job (n=5). The correction table 130C may be used in a case where images are to be formed on ten sheets of the print media 9B in a single print job (n=10). In this example, the plurality of print media 9B may have the same medium width Y1 and the same medium length T1. The correction tables 130, i.e., the correction table 130A, the correction table 130B, and the correction table 130C, may be created, for example but not limited to, with the use of the expression EQ12, and stored in the ROM 85 in advance. Further, a belt waste toner count calculator 82 of the controller 80 may acquire the correction parameter S on the basis of the medium size of the print medium 9B and the medium number of the print medium 9B by means of the correction table 130. The belt waste toner count calculator 82 will be described later. The medium size of the print medium 9B may be expressed with the medium width Y1 and the medium length T1. Further, the belt waste toner count calculator 82 may calculate, with the use of the acquired correction parameter S, the count ΔCNTB of the waste toner to be collected in the waste toner box 47 in the relevant print job.

The controller 80 may control operation of the image forming apparatus 2 on the basis of an instruction given from the CPU 63. The controller 80 may include a printing controller 81 and the belt waste toner count calculator 82.

The printing controller 81 may control printing operation of the image forming apparatus 2. The printing controller 81 may also supply the belt waste toner count calculator 82 with the information related to the medium size and the medium number included in the print data DP.

The belt waste toner count calculator 82 may calculate, with the use of the expressions EQ5 and EQ6, the count ΔCNTB of the waste toner to be collected in the waste toner box 47 in the relevant print job, as with the belt waste toner count calculator 72 according to the first example embodiment described above. Upon the calculation of the count ΔCNTB, the belt waste toner count calculator 82 may acquire the correction parameter S on the basis of the medium size of the print medium 9B by means of the correction table, of the three correction tables 130A, 130B, and 130C, that corresponds to the medium number closest to the medium number of the print media 9B to be subjected to printing. The medium size may be expressed with the medium width Y1 and the medium length T1. The three correction tables 130A, 130B, and 130C may be included in the correction table 130 stored in the ROM 85. The belt waste toner count calculator 82 may calculate, with the use of the correction parameter S, the count ΔCNTB of the waste toner to be collected. Further, the controller 80 may add the count ΔCNTB to the belt waste toner count CNTB stored in the ROM 85. Further, the controller 80 may write, on the ROM 85, a result of the addition as the belt waste toner count CNTB. The controller 80 may thus update the belt waste toner count CNTB.

Figure 12:
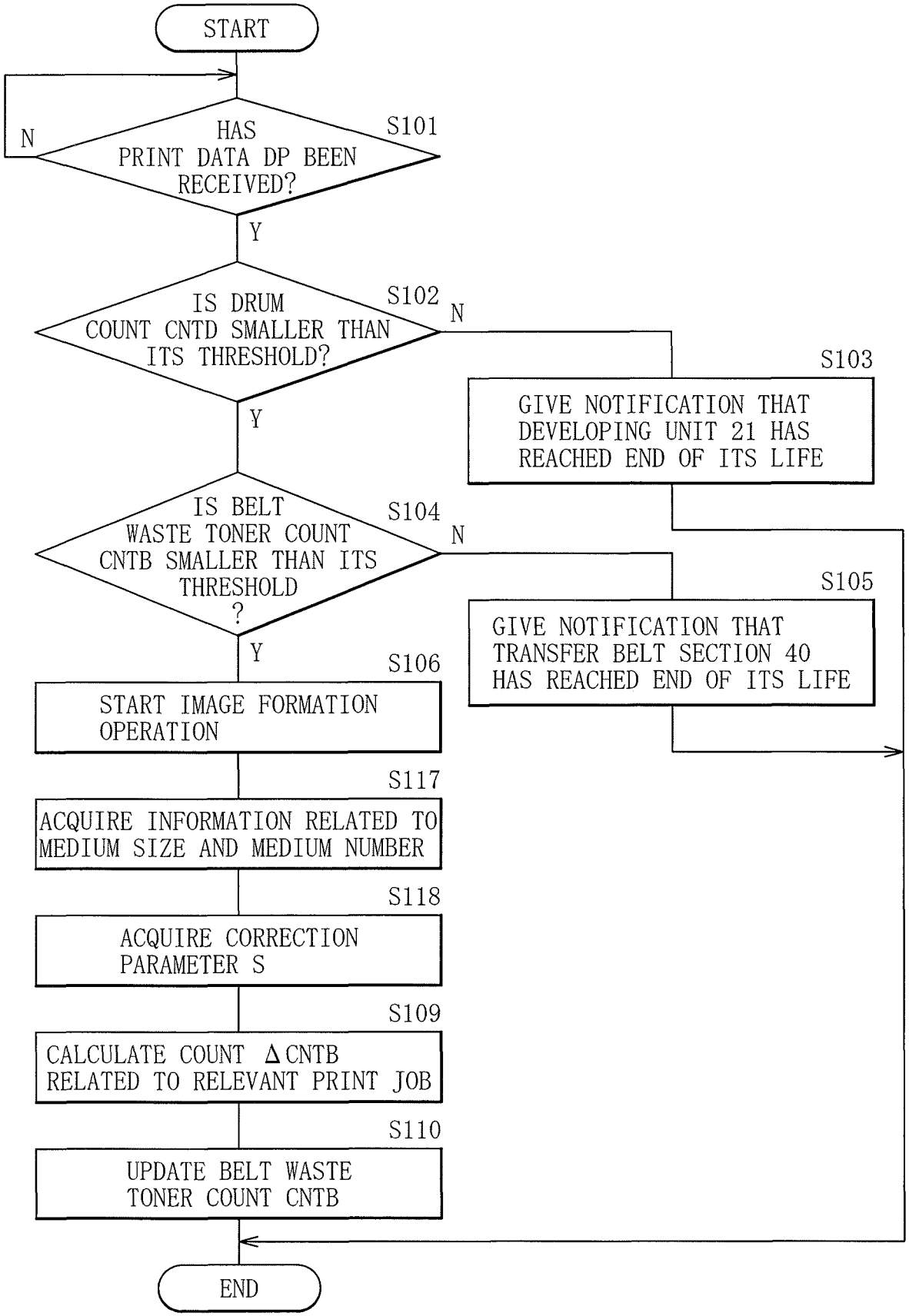
FIG. 12 is a flowchart illustrating an example of operation of an image forming apparatus according to one example embodiment.

FIG. 12 illustrates an example of operation of the image forming apparatus 2 of updating the belt waste toner count CNTB. In this example, the image forming apparatus 2 may perform the image formation operation on the basis of the print data DP including image data corresponding to a plurality of sheets.

As with the controller 70 according to the first example embodiment, the controller 80 may confirm whether the communicator 61 has received the print data DP (step S101). Thereafter, the controller 80 may confirm whether the drum count CNTD stored in the ROM 85 is smaller than its threshold (step S102). Further, the controller 80 may confirm whether the belt waste toner count CNTB stored in the ROM 85 is smaller than its threshold (step S104).

On a condition that the drum count CNTD stored in the ROM 85 is smaller than its threshold and the belt waste toner count CNTB stored in the ROM 85 is smaller than its threshold ("Y" in both steps S102 and S104), the image forming apparatus 2 may start the image formation operation on the basis of the print data DP (step S106).

Thereafter, the belt waste toner count calculator 82 may acquire information related to the medium size of the print medium 9B and the medium number of the print medium 9B included in the print data DP (step S117). The medium size of the print medium 9B may be expressed with the medium width Y1 and the medium length T1.

Thereafter, the belt waste toner count calculator 82 may acquire the correction parameter S on the basis of the information related to the medium size of the print medium 9B and the information related to the medium number of the print medium 9B (step S118). The medium size of the print medium 9B may be expressed with the medium width Y1 and the medium length T1. For example, the belt waste toner count calculator 82 may acquire the correction parameter S on the basis of the medium size of the print medium 9B by means of the correction table, of the three correction tables 130A, 130B, and 130C, that corresponds to the medium number closest to the medium number of the print media 9B acquired in step S117. The three correction tables 130A, 130B, and 130C may be included in the correction table 130 stored in the ROM 85. The medium size of the print medium 9B may be expressed with the medium width Y1 and the medium length T1.

Thereafter, the belt waste toner count calculator 82 may calculate the count ΔCNTB of the waste toner to be collected in the waste toner box 47 in the relevant print job (step S109). For example, the belt waste toner count calculator 82 may calculate the count ΔCNTB with the use of the correction parameter S acquired in step S118, the expression EQ5, and the expression EQ6.

Thereafter, the controller 80 may update the belt waste toner count CNTB stored in the ROM 85 (step S110).

This may bring the flow to the end.

A description is given below of comparison between an actually-measured value of a remaining containable amount R of the waste toner box 47 and a calculated value of the remaining containable amount R of the waste toner box 47.

FIGS. 13A to 13C each illustrate an example of a result of an experiment related to a containable amount Rmeas and a containable amount Rcal. The containable amount Rmeas may be the actually-measured value of the containable amount R. The containable amount Rcal may be the calculated value of the containable amount R. In this experiment, a print job that forms images on a plurality of sheets of the print media 9B on the basis of image data having a duty ratio of 0 (zero) % was performed for a plurality of times until the conveyance distance of the transfer belt 41 reached a predetermined distance corresponding to the life of the transfer belt 41. The plurality of sheets of the print media 9B were three sheets of the print media 9B, five sheets of the print media 9B, and ten sheets of the print media 9B. FIG. 13A illustrates a case where images were formed on three sheets of the print media 9B. FIG. 13B illustrates a case where images were formed on five sheets of the print media 9B. FIG. 13C illustrates a case where images were formed on ten sheets of the print media 9B.

As illustrated in FIGS. 13A to 13C, the image forming apparatus 2 may allow an absolute value of the difference between the containable amount Rmeas, i.e., the actually-measured value of the containable amount R, and the containable amount Rcal, i.e., the calculated value of the containable amount R, to be equal to or smaller than 10% for various medium sizes, various numbers of media, and various environment conditions.

As described above, in the image forming apparatus 2, the belt waste toner count calculator 82 may calculate the count ΔCNTB (the belt waste toner count CNTB) with the use of the correction parameter S based on the medium number. This improves accuracy of calculation of the belt waste toner count CNTB compared to that in a case where the correction parameter S is not varied on the basis of the medium number.

For example, as can be seen from FIGS. 14A to 14C, the absolute value of the difference between the containable amount Rmeas, i.e., the actually-measured value of the containable amount R, and the containable amount Rcal, i.e., the calculated value of the containable amount R, is greater than 10% in many of the cases where the correction parameter S is not varied on the basis of the medium size and the medium number. It is to be noted that FIG. 14A illustrates a case where images were formed on three sheets of the print media 9B. FIG. 14B illustrates a case where images were formed on five sheets of the print media 9B. FIG. 14C illustrates a case where images were formed on ten sheets of the print media 9B. In this example, the single sheet of the print medium 9B may be assumed to have the medium width Y1 of 58 mm and the medium length T1 of 216 mm. In such a case where the accuracy of calculation of the belt waste toner count CNTB is lower, for example, notification that the transfer belt section 40 has reached the end of its life described in step S105 in FIG. 12 can be given earlier or later than appropriate timing.

In contrast, in the image forming apparatus 2, the belt waste toner count calculator 82 may calculate the count ΔCNTB (the belt waste toner count CNTB) with the use of the correction parameter S based on the medium number. Therefore, the accuracy of calculation of the belt waste toner count CNTB is improved also in a case where the medium number of the print medium 9B to be subjected to printing is varied. As a result, for example, notification that the transfer belt section 40 has reached the end of its life may be given at appropriate timing in the image forming apparatus 2.

According to the second example embodiment described above, the count ΔCNTB (a belt waste toner count) may be calculated with the use of a correction parameter based on the medium number. Therefore, it is possible to improve accuracy of calculation of the belt waste toner count also in a case where the medium number of a print medium to be subjected to printing is varied. As a result, it is possible to, for example, give notification that a transfer belt section has reached the end of its life at appropriate timing. Other example effects may be similar to those of the first example embodiment described above.

Modification Example 2-1

In the second example embodiment described above, the belt waste toner count calculator 82 may acquire the correction parameter S on the basis of the medium size of the print medium 9B and the medium number of the print medium 9B by means of the correction table 130. The medium size of the print medium 9B may be expressed with the medium width Y1 and the medium length T1. The correction table 130 may be stored in the ROM 85. However, this is non-limiting. In an alternative example, the correction parameter S may be calculated on the basis of the medium size of the print medium 9B and the medium number of the print medium 9B with the use of the expression EQ12 without providing the correction table 130.

Modification Example 2-2

In the second example embodiment described above, the correction parameter S may be acquired on the basis of the medium size of the print medium 9B and the medium number of the print medium 9B. The medium size of the print medium 9B may be expressed with the medium width Y1 and the medium length T1. However, this is non-limiting. For example, in a case of an image forming apparatus that forms an image only on the print medium 9B having a predetermined medium size, the medium size expressed with the medium width Y1 and the medium length T1 may be fixed. Therefore, the correction parameter S may be acquired only on the basis of the medium number. In this case, the correction table 130 may include information related to the correction parameter S associated with the predetermined medium size, for example.

3. Third Example Embodiment

A description is given below of an image forming apparatus 3 according to a third example embodiment. According to the third example embodiment, the correction parameter S may be calculated on the basis of the medium thickness in addition to the medium size. It is to be noted that component parts that are substantially the same as those of the image forming apparatus 1 according to the first example embodiment described above are denoted with the same numerals and may not be described further where appropriate.

Figure 15:
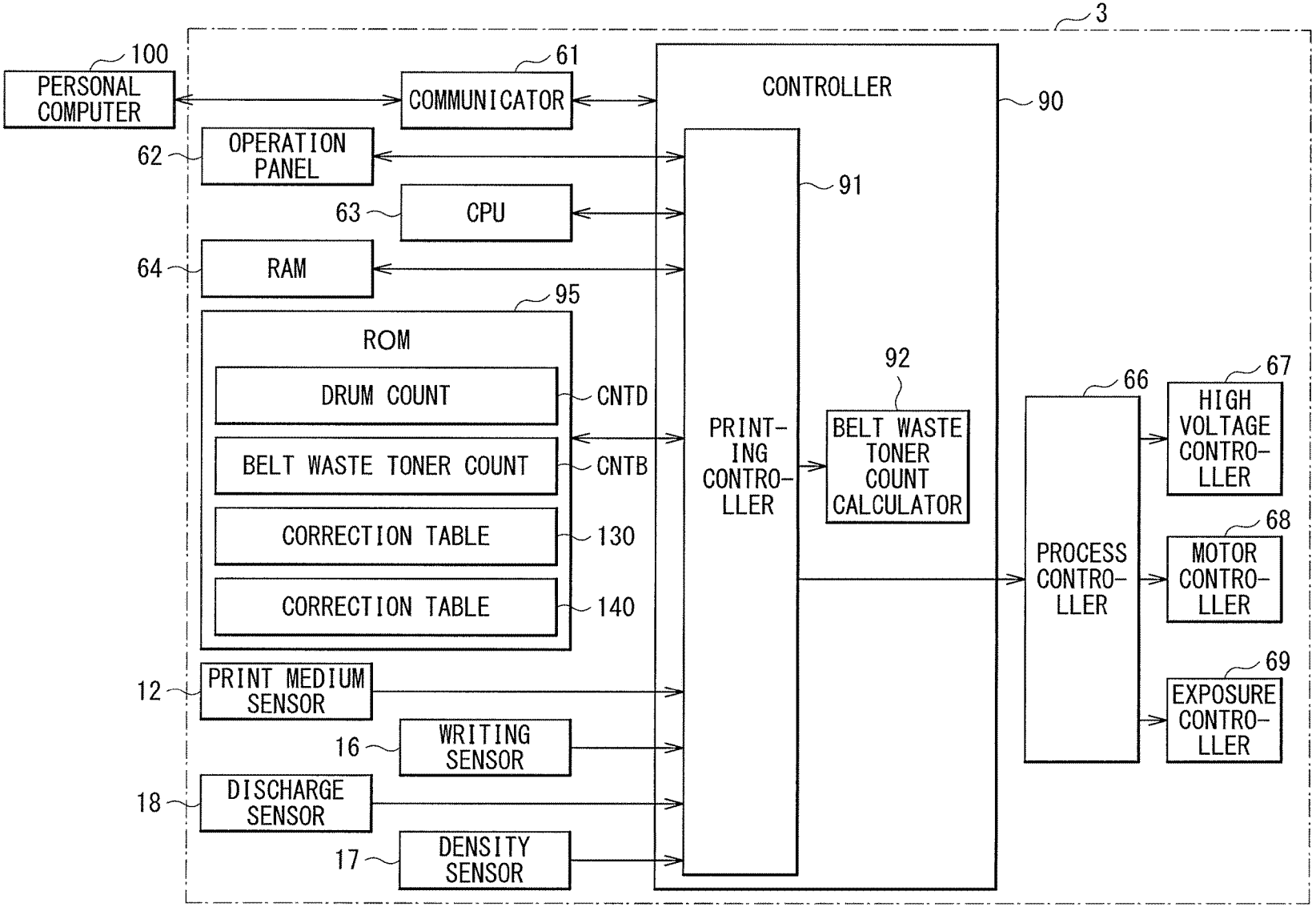
FIG. 15 is a block diagram illustrating an example of a control mechanism of an image forming apparatus according to one example embodiment.

FIG. 15 illustrates an example of a control mechanism of the image forming apparatus 3. The image forming apparatus 3 may include a ROM 95 and a controller 90.

The ROM 95 may hold the correction table 130 and a correction table 140. The correction table 140 may include information related to a correction parameter Mw associated with a medium thickness of the print medium 9B to be subjected to printing. In this example, the medium thickness may be expressed in medium grammage.

As described above, when the image forming apparatus 3 transfers the toner image formed on the photosensitive drum 31 onto the print medium 9B, the toner present on the print-medium region may move onto the print medium 9B, and the toner present on the non-print-medium region may move onto the transfer belt 41. As a result, the gray background toner may move onto the transfer belt 41. An amount of the gray background toner to move from the surface of the photosensitive drum 31 onto the transfer belt 41 may vary depending on the medium thickness.

Figures 16, 17:
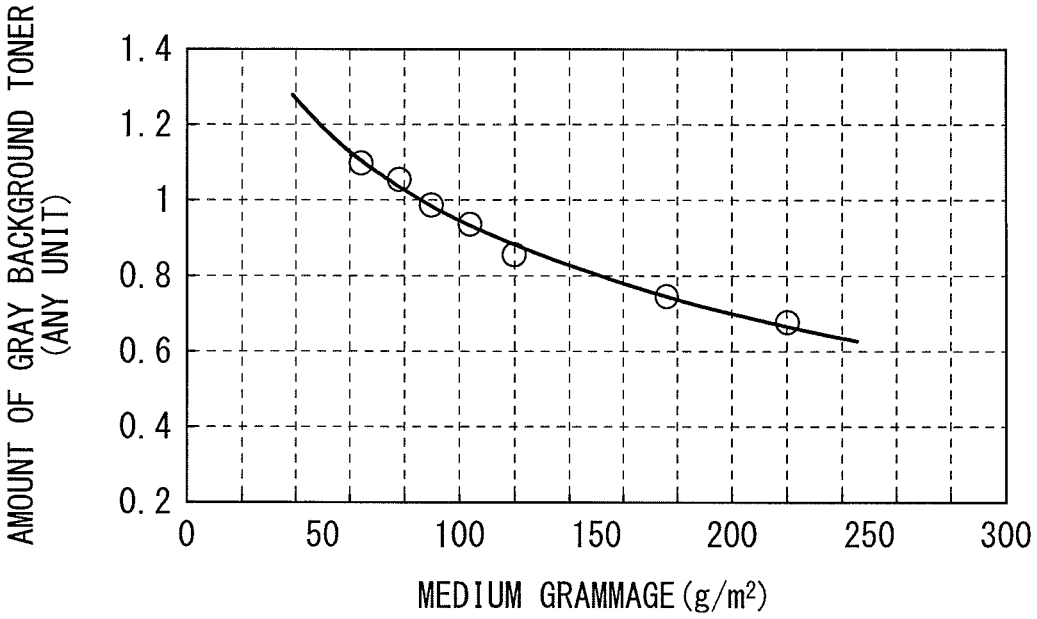
FIG. 16 is a characteristic diagram illustrating an example of a relationship between an amount of a gray background toner and a medium grammage.
FIG. 17 is a table illustrating an example of a correction table according to one example embodiment.

FIG. 16 illustrates a relationship between the amount of the gray background toner moved onto the transfer belt 41 and the medium grammage. As can be seen from FIG. 16, the smaller the medium thickness is, i.e., the smaller the medium grammage is, the greater amount of the gray background toner may move onto the transfer belt 41. One reason for this may be as follows. When the image forming apparatus 3 transfers the toner image formed on the photosensitive drum 31 onto the print medium 9B, the high voltage controller 67 may adjust the transfer voltage to be applied to the transfer roller 42 on the basis of a current flowing between the photosensitive drum 31 and the transfer roller 42 that face each other. For example, in a case where the medium thickness of the print medium 9B is smaller, a greater amount of current may flow between the photosensitive drum 31 and the transfer roller 42 that face each other. Therefore, the high voltage controller 67 may adjust the transfer voltage to be lower. This makes it easier for a toner that is negatively charged but has a low charge amount or a positively-charged toner to move onto the transfer belt 41. As a result, the greater amount of gray background toner may move onto the transfer belt 41 as the medium thickness is smaller. In this example, the controller 90 may calculate the amount of the gray background toner to be collected in the waste toner box 47 with the use of the correction parameter Mw associated with the medium grammage of the print medium 9B.

FIG. 17 illustrates an example of a configuration of the correction table 140. In this example, the correction table 140 may include the correction parameters Mw for various values of medium grammage. In this example, a medium grammage W1 may be classified into seven ranges. The correction table 140 may be stored in the ROM 95 in advance. A belt waste toner count calculator 92 of the controller 90 may acquire the correction parameter S on the basis of the medium size of the print medium 9B and the medium number of the print medium 9B by means of the correction table 130, and may acquire the correction parameter Mw on the basis of the medium grammage W1 of the print medium 9B by means of the correction table 140. The belt waste toner count calculator 92 will be described later. The medium size of the print medium 9B may be expressed with the medium width Y1 and the medium length T1. Further, the belt waste toner count calculator 92 may calculate, with the use of the acquired correction parameter S and the acquired correction parameter Mw, the count ΔCNTB of the waste toner to be collected in the waste toner box 47 in the relevant print job.

The controller 90 may control the operation of the image forming apparatus 3 on the basis of an instruction given from the CPU 63. The controller 90 may include a printing controller 91 and the belt waste toner count calculator 92.

The printing controller 91 may control printing operation of the image forming apparatus 3. The printing controller 91 may also supply the belt waste toner count calculator 92 with the medium information included in the print data DP. The medium information may include, for example but not limited to, the medium size, the medium number, the medium type, and the medium thickness.

The belt waste toner count calculator 92 may calculate, on the basis of the print data DP, the count ΔCNTB of the waste toner to be collected in the waste toner box 47 in the relevant print job. In this example, the belt waste toner count calculator 92 may calculate the count ΔCNTB by the following expression.

$$\Delta CNTB = \Delta CNTB0 + \Delta CNTBbg \times Mw \quad \text{(EQ13)}$$

Upon the calculation of the count ΔCNTB, the belt waste toner count calculator 92 may acquire the correction parameter S on the basis of the medium size of the print medium 9B by means of the correction table, of the three correction tables 130A, 130B, and 130C, that corresponds to the medium number closest to the medium number of the print media 9B to be subjected to printing. The medium size may be expressed with the medium width Y1 and the medium length T1. The three correction tables 130A, 130B, and 130C may be included in the correction table 130 stored in the ROM 95. The belt waste toner count calculator 92 may acquire the correction parameter Mw on the basis of the medium thickness, i.e., the medium grammage W1, by means of the correction table 140 stored in the ROM 95. The belt waste toner count calculator 92 may calculate, with the use of the correction parameter S and the correction parameter Mw, the count ΔCNTB of the waste toner to be collected. Further, the controller 90 may add the count ΔCNTB to the belt waste toner count CNTB stored in the ROM 95. Further, the controller 90 may write, on the ROM 95, a result of the addition as the belt waste toner count CNTB. The controller 90 may thus update the belt waste toner count CNTB.

Figure 18:
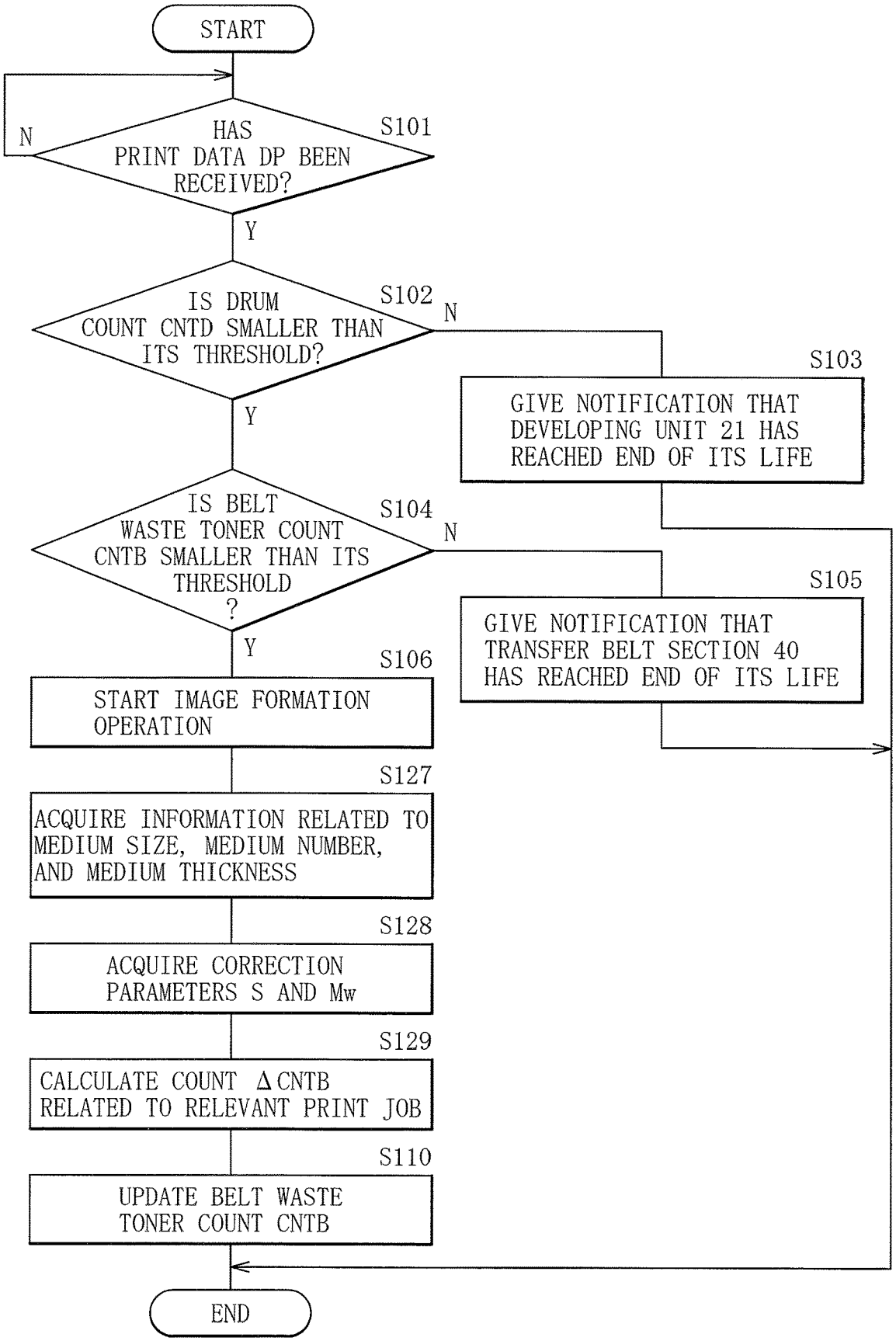
FIG. 18 is a flowchart illustrating an example of operation of an image forming apparatus according to one example embodiment.

FIG. 18 illustrates an example of operation of the image forming apparatus 3 of updating the belt waste toner count CNTB.

As with the controller 70 according to the first example embodiment, the controller 90 may confirm whether the communicator 61 has received the print data DP (step S101). Thereafter, the controller 90 may confirm whether the drum count CNTD stored in the ROM 95 is smaller than its threshold (step S102). Further, the controller 90 may confirm whether the belt waste toner count CNTB stored in the ROM 95 is smaller than its threshold (step S104).

On a condition that the drum count CNTD stored in the ROM 95 is smaller than its threshold and the belt waste toner count CNTB stored in the ROM 95 is smaller than its threshold ("Y" in both steps S102 and S104), the image forming apparatus 3 may start the image formation operation on the basis of the print data DP (step S106).

Thereafter, the belt waste toner count calculator 92 may acquire information related to the medium size of the print medium 9B, the medium number of the print medium 9B, and the medium thickness of the print medium 9B included in the print data DP (step S127). The medium size of the print medium 9B may be expressed with the medium width Y1 and the medium length T1. The medium thickness of the print medium 9B may be expressed as the medium grammage W1.

Thereafter, the belt waste toner count calculator 92 may acquire the correction parameter S and the correction parameter Mw on the basis of the information related to the medium size of the print medium 9B, the information related to the medium number of the print medium 9B, and the information related to the medium thickness of the print medium 9B (step S128). The medium size of the print medium 9B may be expressed with the medium width Y1 and the medium length T1. The medium thickness of the print medium 9B may be expressed as the medium grammage W1. For example, the belt waste toner count calculator 92 may acquire the correction parameter S on the basis of the medium size of the print medium 9B by means of the correction table, of the three correction tables 130A, 130B, and 130C, that corresponds to the medium number closest to the medium number of the print medium 9B acquired in step S127. The medium size of the print medium 9B may be expressed with the medium width Y1 and the medium length T1. The three correction tables 130A, 130B, and 130C may be included in the correction table 130 stored in the ROM 95. The belt waste toner count calculator 92 may also acquire the correction parameter Mw on the basis of the information related to the medium thickness of the print medium 9B acquired in step S127 by means of the correction table 140 stored in the ROM 95. The medium thickness of the print medium 9B may be expressed as the medium grammage W1.

Thereafter, the belt waste toner count calculator 92 may calculate the count ΔCNTB of the waste toner to be collected in the waste toner box 47 in the relevant print job (step S129). For example, the belt waste toner count calculator 92 may calculate the count ΔCNTB with the use of the correction parameter S and the correction parameter Mw both acquired in step S128, the expression EQ13, and the expression EQ6.

Thereafter, the controller 90 may update the belt waste toner count CNTB stored in the ROM 95 (step S110).

This may bring the flow to the end.

A description is given below of comparison between an actually-measured value of a remaining containable amount R of the waste toner box 47 and a calculated value of the remaining containable amount R of the waste toner box 47.

FIG. 19 illustrates an example of a result of an experiment related to a containable amount Rmeas and a containable amount Rcal. The containable amount Rmeas may be the actually-measured value of the containable amount R. The containable amount Rcal may be the calculated value of the containable amount R. In this experiment, a print job that forms an image on the print medium 9B on the basis of image data having a duty ratio of 0 (zero) % was performed for a plurality of times until the conveyance distance of the transfer belt 41 reached a predetermined distance corresponding to the life of the transfer belt 41. As can be seen from FIG. 19, the image forming apparatus 3 may allow an absolute value of the difference between the containable amount Rmeas, i.e., the actually-measured value of the containable amount R, and the containable amount Rcal, i.e., the calculated value of the containable amount R, to be equal to or smaller than 10% for various medium thicknesses, i.e., various medium grammages W1.

As described above, in the image forming apparatus 3, the belt waste toner count calculator 92 may calculate the count ΔCNTB (the belt waste toner count CNTB) with the use of the correction parameter Mw based on the medium thickness, e.g., the medium grammage W1. This improves accuracy of calculation of the belt waste toner count CNTB compared to that in a case without using the correction parameter Mw.

In other words, an image forming apparatus 3R that does not use the correction parameter Mw, the absolute value of the difference between the containable amount Rmeas, i.e., the actually-measured value of the containable amount R, and the containable amount Rcal, i.e., the calculated value of the containable amount R, is greater than 10% in some cases as illustrated in FIG. 19.

For example, in this example, the absolute value of the difference between the containable amount Rmeas, i.e., the actually-measured value of the containable amount R, and the containable amount Rcal, i.e., the calculated value of the containable amount R, may be greater than 10% in a case where the medium grammage W1 is equal to or smaller than 82 g/m$^2$. In other words, the image forming apparatus 3R may estimate lower the count ΔCNTB of the waste toner to be collected in the waste toner box 47 in a case where the medium thickness, e.g., the medium grammage W1, is smaller. Therefore, the absolute value of the difference between the actually-measured value of the containable amount R and the calculated value of the containable amount R may be greater in the image forming apparatus 3R. In this case, the waste toner box 47 may be full. In other words, as the count ΔCNTB is estimated lower, the notification that the transfer belt section 40 has reached the end of its life may be given later than appropriate timing.

For example, in this example, the absolute value of the difference between the containable amount Rmeas, i.e., the actually-measured value of the containable amount R, and the containable amount Rcal, i.e., the calculated value of the containable amount R, may be greater than 10% in a case where the medium grammage W1 is greater than 120 g/m$^2$. In other words, the image forming apparatus 3R may estimate greater the count ΔCNTB of the waste toner to be collected in the waste toner box 47 in a case where the medium thickness, e.g., the medium grammage W1, is greater. Therefore, the absolute value of the difference between the actually-measured value of the containable amount R and the calculated value of the containable amount R may be greater in the image forming apparatus 3R. In this case, the notification that the transfer belt section 40 has reached the end of its life may be given in a state where the remaining containable amount R is equal to or greater than 10%. In other words, as the count ΔCNTB is estimated greater, the notification that the transfer belt section 40 has reached the end of its life may be given earlier.

In contrast, in the image forming apparatus 3, the belt waste toner count calculator 92 may calculate the count ΔCNTB (the belt waste toner count CNTB) with the use of the correction parameter Mw according to the medium thickness, e.g., the medium grammage W1. Therefore, the accuracy of calculation of the belt waste toner count CNTB is improved also in a case where the medium thickness of the print medium 9B to be subjected to printing is varied. As a result, for example, notification that the transfer belt section 40 has reached the end of its life may be given at appropriate timing in the image forming apparatus 3.

According to the third example embodiment described above, the count ΔCNTB (a belt waste toner count) may be calculated with the use of a correction parameter based on the medium thickness. Therefore, it is possible to improve accuracy of calculation of the belt waste toner count also in a case where the medium thickness of a print medium to be subjected to printing is varied. As a result, it is possible to, for example, give notification that a transfer belt section has reached the end of its life at appropriate timing. Other example effects may be similar to those of the first example embodiment described above.

Modification Example 3-1

In the third example embodiment described above, the belt waste toner count calculator 92 may calculate the count ΔCNTB on the basis of the information related to the medium thickness included in the print data DP. However, this is non-limiting. In an alternative example, the belt waste toner count calculator 92 may calculate the count ΔCNTB on the basis of the information related to the medium thickness set in the image forming apparatus 3. In another example, the image forming apparatus 3 may be provided with a sensor that detects the medium thickness of the print medium 9B. In this case, the belt waste toner count calculator 92 may calculate the count ΔCNTB on the basis of the medium thickness detected by the provided sensor.

Modification Example 3-2

In the third example embodiment described above, the correction parameter S may be acquired on the basis of the medium size of the print medium 9B, the medium number of the print medium 9B, and the medium thickness of the print medium 9B. The medium size of the print medium 9B may be expressed with the medium width Y1 and the medium length T1. However, this is non-limiting. For example, in a case of an image forming apparatus that forms an image only on the print medium 9B having a predetermined medium size, the medium size expressed with the medium width Y1 and the medium length T1 may be fixed. Therefore, the correction parameter S may be acquired only on the basis of the medium number and the medium thickness in one example. In another example, the correction parameter S may be acquired only on the basis of the medium thickness.

The technology has been described above referring to some example embodiments and the modification examples thereof. However, the technology is not limited to the example embodiments and the modification examples described above, and is modifiable in various ways.

For example, in the example embodiments and the modification examples thereof described above, the notification that the transfer belt section 40 has reached the end of its life is given on the basis of the belt waste toner count CNTB. However, this is non-limiting. In an alternative example, the notification that the transfer belt section 40 has reached the end of its life may be given on the basis of the belt waste toner count CNTB. In another example, information related to the life of the transfer belt section 40 may be presented to the user. Non-limiting examples of the information related to the life of the transfer belt section 40 may include the remaining containable amount R in the waste toner box 47.

For example, in the example embodiments and the modification examples thereof described above, an image may be formed with the use of three colors of toners. However, this is non-limiting. In an alternative example, an image may be formed with the use of four or more colors of toners. In a case where four colors of toners are used, for example, a cyan toner, a magenta toner, a yellow toner, and a black toner may be used. In a case where five colors of toners are used, for example, a cyan toner, a magenta toner, a yellow toner, a black toner, a white toner, and a transparent toner may be used.

For example, in the example embodiments and the modification examples thereof described above, a color image may be formed on the print medium 9. However, this is non-limiting. In one example, a monochrome image may be formed on the print medium 9.

For example, in the example embodiments and the modification examples thereof described above, the print medium 9 having a long length may be used. However, this is non-limiting. In one example, plane paper or a cut sheet of paper may be used.

For example, in the example embodiments and the modification examples thereof described above, the toner image formed by the developing unit 21 may be transferred directly onto the print medium 9B. However, this is non-limiting. In an alternative example, the toner formed by the developing unit 21 may be once transferred onto an intermediate transfer belt, and the toner image transferred on the intermediate belt may be transferred in turn onto the print medium 9B.

For example, the example embodiments and the modification examples described above may each be applied to a single-function printer. However, this is non-limiting. In an alternative example, any of the example embodiments and the modification examples of the technology may be applied to a so-called multi-function peripheral (MFP) having functions such as a copy function, a facsimile function, a scanning function, or a printing function. In another example, any of the example embodiments and the modification examples of the technology may be applied to a single-function copier or a single-function facsimile.

For example, in the example embodiments and the modification examples thereof described above, a sensor that directly detects the amount of the waste toner may not be provided inside the waste toner box 47. However, this is non-limiting. In an alternative example, the sensor that detects the amount of the waste toner may be provided inside the waste toner box 47.

Furthermore, the technology encompasses any possible combination of some or all of the various embodiments and the modifications described herein and incorporated herein. It is possible to achieve at least the following configurations from the above-described example embodiments of the technology.

(1)

An image forming apparatus including:

a developing unit that includes an image carrier carrying a developer image;

a transfer section that includes a transfer belt, a cleaning member, and a container, and transfers the developer image onto a print medium, the transfer belt being disposed in contact with the image carrier, the cleaning member removing a developer attached to the transfer belt, the container containing the developer removed by the cleaning member; and a calculator that calculates a collection amount on the basis of medium information of the print medium, the collection amount being an amount of the developer collected in the container.

(2)

The image forming apparatus according to (1), in which the medium information includes information related to a medium size of the print medium, and the calculator calculates the collection amount on the basis of the medium size.

(3)

The image forming apparatus according to (2), in which the calculator obtains information related to a life of the transfer section on the basis of the calculated collection amount.

(4)

The image forming apparatus according to (2) or (3), further including a storage device that holds a correction table including a correction parameter associated with the medium size, in which the calculator acquires the correction parameter with use of the correction table, and calculates the collection amount on the basis of the acquired correction parameter, the correction parameter being associated with the medium size of the print medium on which the developer image is to be formed.

(5)

The image forming apparatus according to any one of (2) to (4), in which the collection amount is greater as the medium size is smaller.

(6)

The image forming apparatus according to any one of (2) to (5), in which the medium information further includes information related to a medium number, the medium number being number of the print medium on which the developer image is to be formed, and the calculator calculates the collection amount also on the basis of the medium number in addition to the medium size.

(7)

The image forming apparatus according to any one of (2) to (6), in which the medium information further includes information related to a medium thickness, the medium thickness being a thickness of the print medium on which the developer image is to be formed, and the calculator calculates the collection amount also on the basis of the medium thickness in addition to the medium size.

(8)

The image forming apparatus according to any one of (2) to (7), further including a communicator that receives print data, the print data including image data and the information related to the medium size, the image data corresponding to the developer image, in which the calculator calculates the collection amount on the basis of the information related to the medium size included in the print data.

(9)

The image forming apparatus according to (1), in which the medium information includes information related to a medium number, the medium number being number of the print medium on which the developer image is to be formed, and the calculator calculates the collection amount on the basis of the medium number.

(10)

The image forming apparatus according to (1), in which the medium information includes information related to a medium thickness, the medium thickness being a thickness of the print medium on which the developer image is to be formed, and the calculator calculates the collection amount on the basis of the medium thickness.

(11)

The image forming apparatus according to (9), in which the medium information further includes information related to a medium thickness, the medium thickness being a thickness of the print medium on which the developer image is to be formed, and the calculator calculates the collection amount also on the basis of the medium thickness in addition to the medium number.

(12)

An image forming method including:

transferring, with a transfer section, a developer image onto a print medium, the transfer section including a transfer belt disposed in contact with an image carrier, the developer image being carried by the image carrier;

removing, with a cleaning member of the transfer section, a developer attached to the transfer belt;

containing, in a container of the transfer section, the developer removed by the cleaning member; and calculating, with a calculator, a collection amount on the basis of medium information of the print medium, the collection amount being an amount of the developer collected in the container.

According to any of the image forming apparatus and the image forming method according to one embodiment of the technology, the collection amount of the developer collected in the container is calculated on the basis of the medium information of the print medium. Hence, it is possible to give notification related a life at appropriate timing.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

a developing unit that includes an image carrier carrying a developer image;

a transfer section that includes a transfer belt, a cleaning member, and a container, and transfers the developer image onto a print medium, the transfer belt being disposed in contact with the image carrier, the cleaning member removing a developer attached to the transfer belt, the container containing the developer removed by the cleaning member; and a calculator that calculates a collection amount on a basis of a medium size of the print medium, the collection amount being an amount of the developer collected in the container.

2. The image forming apparatus according to claim 1, wherein the calculator obtains information related to a life of the transfer section on a basis of the calculated collection amount.

3. The image forming apparatus according to claim 1, further comprising a storage device that holds a correction table including a correction parameter associated with the medium size, wherein the calculator acquires the correction parameter with use of the correction table, and calculates the collection amount on a basis of the acquired correction parameter, the correction parameter being associated with the medium size of the print medium on which the developer image is to be formed.

4. The image forming apparatus according to claim 1, wherein the collection amount is greater as the medium size is smaller.

5. The image forming apparatus according to claim 1, wherein the medium information further includes information related to a medium number, the medium number being number of the print medium on which the developer image is to be formed, and the calculator calculates the collection amount also on a basis of the medium number in addition to the medium size.

6. The image forming apparatus according to claim 1, wherein the medium information further includes information related to a medium thickness, the medium thickness being a thickness of the print medium on which the developer image is to be formed, and the calculator calculates the collection amount also on a basis of the medium thickness in addition to the medium size.

7. The image forming apparatus according to claim 1, further comprising a communicator that receives print data, the print data including image data and the information related to the medium size, the image data corresponding to the developer image, wherein the calculator calculates the collection amount on a basis of the information related to the medium size included in the print data.

8. An image forming method comprising:

transferring, with a transfer section, a developer image onto a print medium, the transfer section including a transfer belt disposed in contact with an image carrier, the developer image being carried by the image carrier;

removing, with a cleaning member of the transfer section, a developer attached to the transfer belt;

containing, in a container of the transfer section, the developer removed by the cleaning member; and calculating, with a calculator, a collection amount on a basis of a medium size of the print medium, the collection amount being an amount of the developer collected in the container.

9. An image forming apparatus comprising:

a developing unit that includes an image carrier carrying a developer image;

a transfer section that includes a transfer belt, a cleaning member, and a container, and transfers the developer image onto a print medium, the transfer belt being disposed in contact with the image carrier, the cleaning member removing a developer attached to the transfer belt, the container containing the developer removed by the cleaning member; and a calculator that calculates a collection amount on a basis of a medium thickness of the print medium, the collection amount being an amount of the developer collected in the container, the medium thickness being a thickness of the print medium on which the developer image is to be formed.

10. The image forming apparatus according to claim 9, wherein the calculator calculates the collection amount also on a basis of a medium number in addition to the medium thickness, the medium number being a number of the print medium on which the developer image is to be formed.

* * * * *